US006032949A

United States Patent [19]

Ando

[11] Patent Number: 6,032,949

[45] **Date of Patent: *Mar. 7, 2000**

[54] SHEET CONVEYING DEVICE AND SHEET PROCESSING APPARATUS

[75] Inventor: Masao Ando, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/717,729

[22] Filed: Sep. 23, 1996

[30] Foreign Application Priority Data

Oct. 3, 1995 [JP] Japan ..... 7-284561
Apr. 25, 1996 [JP] Japan ..... 8-105894

[51] Int. Cl.[7] ..... B65H 5/00

[52] U.S. Cl. ..... 271/225; 271/236; 271/242; 271/251; 271/252; 271/270; 271/186; 271/902

[58] Field of Search ..... 271/225, 246, 271/228, 236, 239, 248, 250, 251, 252, 270, 185, 186, 902, 242

[56] References Cited

U.S. PATENT DOCUMENTS 4,685,664 8/1987 Petersdorf ..... 271/236
5,092,579 3/1992 Tokoro et al. ..... 271/248
5,162,857 11/1992 Higeta et al. ..... 271/251
5,167,409 12/1992 Higeta ..... 271/251
5,219,159 6/1993 Malachowski et al. ..... 271/228
5,225,881 7/1993 Goto et al. .
5,240,242 8/1993 Ando et al. .
5,358,230 10/1994 Ikemori et al. .
5,386,983 2/1995 Ando .
5,482,265 1/1996 Nakazato et al. ..... 271/270

FOREIGN PATENT DOCUMENTS 0248845 11/1986 Japan ..... 271/228
0198952 8/1990 Japan ..... 271/228
40409145 2/1992 Japan ..... 271/228
405124752A 5/1993 Japan ..... 271/236

*Primary Examiner*—H. Grant Skaggs
*Attorney, Agent, or Firm*—Fitzpatrick, Cella, Harper & Scinto

[57] ABSTRACT

In a sheet conveying device, sheets having of various width sizes can be adjusted to sheet conveyance reference of a regulating device without moving the regulating device in the lateral direction of a sheet. An image forming apparatus uses two kinds or sheets of different width sizes (the LTR-size and the A4-size). The regulating device is fixed to a position where an LTR-size sheet can be regulated. When performing switchback conveyance of an A4-size sheet, switchback conveying devices convey the sheet while moving it toward the sheet conveyance reference of the regulating device by a predetermined amount.

47 Claims, 27 Drawing Sheets

SHEET CONVEYING DEVICE AND SHEET PROCESSING APPARATUS

BACKGROUND OF THE INVENTION

1. Field of the Invention

This invention relates to a sheet conveying device mounted in a sheet processing apparatus, such as a printer, a copier, a facsimile apparatus, a scanner or the like. An apparatus having a sheet processing means for performing predetermined processing (such as image formation, image reading or the like) for individually fed sheets is generically called a sheet processing apparatus.

2. Description of the Related Art

Some image forming apparatuses, such as printers, copiers, facsimile apparatuses and the like, for performing printing only on one surface of a sheet which have only a sheet conveying path for simplex printing within the main body of the apparatus can perform printing on both surfaces of a sheet by mounting an optional sheet conveying device for duplex printing.

The sheet conveying device for duplex printing is detachably mounted on the main body of the apparatus, and can convey a sheet having an image formed on its first surface discharged from the main body of the apparatus into the main body of the apparatus while reversing the surface of the sheet. Usually, the surface of the sheet having an image formed on its first surface is reversed by switchback conveying means (comprising, for example, a pair of rollers capable of rotating in forward and reverse directions) in order to change the conveying state from ordinary conveyance to switchback conveyance. The surface of the sheet is reversed during the switchback conveyance.

The sheet conveying device for duplex printing also has the ability to convey the sheet into the main body of the image forming apparatus by adjusting the position of the sheet from the lateral direction to a correct position (conveyance reference) so that printing on the second surface of the sheet is performed at a correct position. This function is achieved by a regulating member provided at a downstream portion from the switchback conveying means. The sheet having the image on its first surface subjected to switchback conveyance by the switchback conveying means is conveyed into the main body of the image forming apparatus in a state in which a side of the sheet in the lateral direction contacts the conveyance reference of the regulating member.

A conventional regulating member changes the position of the sheet in the lateral direction in accordance with the width size of the sheet subjected to switchback conveyance. Thus, the conveyance reference is set to a position corresponding to the width size of the sheet.

In the above-described conventional approach, however, since means for moving the regulating member in the lateral direction of the sheet is required, the device has a complicated structure, resulting in a high cost.

In the conventional sheet conveying device for duplex printing, (1) the switchback conveying means is already in a normal conveyance state when a sheet having a printed image on its first surface thereof has been discharged from the main body of the image forming apparatus, and (2) the switchback conveying means conveys straight the sheet having the printed image on its first surface when performing switchback conveyance of the sheet.

However, when using the conventional sheet conveying device (for duplex printing), a jam tends to occur, or printing on the second surface cannot, in some cases, be correctly performed.

That is, the sheet having the printed image on its first surface discharged from the main body of the image forming apparatus often obliquely moves. In the above-described conventional approach, however, since the sheet having the printed image on its first surface is subjected to normal conveyance by the switchback conveying means in a state in which the skew of the sheet is not corrected, the amount of skew gradually increases, thereby tending to produce a jam, for example, in a retracting path.

The conventional device has the regulating means (single-side conveyance reference) for regulating the position of the sheet having the printed image on its first surface that is subjected to switchback conveyance from the switchback conveying means in the lateral direction. However, since the sheet subjected to switchback conveyance by the switchback conveying means moves straight, a side of the sheet in the lateral direction cannot, in some cases, contact the regulating means. Since such a sheet is conveyed to an image forming portion in a state in which the position of the sheet in the lateral direction is not regulated, printing on the second surface cannot be correctly performed. This is because, in the image forming portion, printing on the second surface is started from a position corresponding to the regualating position by the regulating means.

SUMMARY OF THE INVENTION

The present invention has been. made in consideration of the above-described problems.

It is an object of the present invention to provide a sheet conveying device capable of conveying sheets having different width sizes in a state of being adjusted to conveyance reference even if a regulating member is fixed at a certain position without being moved in the lateral direction of a sheet.

It is another object of the present invention to provide a sheet conveying device in which a jam due to skew of a sheet seldom occurs, and in which the regulation of the position of a sheet subjected to switchback conveyance by switchback conveying means in the lateral direction can be assuredly performed.

According to one aspect, the present invention which achieves these objectives relates to a sheet conveying device comprising sheet conveying means for conveying a sheet, and a regulating member for setting a sheet conveyance reference position at a portion downstream from the sheet conveying means. When the sheet conveying means conveys a sheet of a specific width size, the sheet is conveyed while being moved by a predetermined amount toward the sheet conveyance reference position of the regulating member.

According to another aspect, the present invention which achieves these objectives relates to a sheet conveying device comprising switchback conveying means for performing switchback conveyance of a sheet after ordinary conveyance. After correcting a skewed state of the sheet by the switchback conveying means, ordinary conveyance of the sheet is performed by the switchback conveying means.

According to still another aspect, the present invention which achieves these objectives relates to a sheet conveying device comprising switchback conveying means for performing switchback conveyance of a sheet, subjected to first processing and discharged from a main body of a sheet processing apparatus, into the main body of the sheet processing apparatus after performing ordinary conveyance of the sheet. After correcting a skewed state of the sheet subjected to the first processing and discharged from the main body of the sheet processing apparatus by the switchback conveying means, the sheet subjected to the first processing is subjected to ordinary conveyance by the switchback conveying means.

According to still another aspect, the present invention which achieves these objectives relates to a sheet conveying device comprising switchback conveying means for performing switchback conveyance of a sheet after performing ordinary conveyance of the sheet. The switchback conveying means obliquely feeds the sheet during switchback conveyance.

According to still another aspect, the present invention which achieves these objectives relates to a sheet conveying device comprising switchback conveying means for performing switchback conveyance of a sheet, subjected to first processing and discharged from a main body of a sheet processing apparatus, into the main body of the sheet processing apparatus after performing ordinary conveyance of the sheet. The switchback conveying means obliquely feeds the sheet subjected to the first processing during the switchback conveyance.

According to still another aspect, the present invention which achieves these objectives relates to a sheet processing apparatus comprising the above-described sheet conveying device mounted in a main body of the apparatus. When the sheet conveying device is mounted in the main body of the apparatus, a printing operation of a second mode can be performed, the sheet subjected to the first processing is fed into the sheet conveying device, and the sheet subjected to the first processing discharged from the sheet conveying device is conveyed to a sheet processing unit.

According to still another aspect, the present invention which achieves these objectives relates to a sheet conveying device comprising first conveying means capable of conveying a sheet and shifting the sheet in a direction crossing a conveying direction, a regulating member, disposed at a side downstream from the first conveying means, for regulating the position of a side portion of the sheet conveyed by the conveying means by contacting the side portion of the sheet, second conveying means, disposed at a side downstream from the first conveying means, for moving the sheet so as to press it against the regulating member while conveying the sheet, and control means for controlling the first conveying means so as to shift a first sheet having a first width in a direction crossing the conveying direction, and so as not to shift a second sheet having a second width different from the first width.

According to still another aspect, the present invention which achieves these objectives relates to an image forming apparatus comprising image forming means for forming an image on a sheet. The first conveying means is capable of conveying the sheet having the image formed thereon and shifting the sheet in a direction crossing a conveying direction, regulating member, disposed at a side downstream from the first conveying means, for regulating the position of a side portion of the sheet conveyed by the first conveying means by contacting the side portion of the sheet. The second conveying means, disposed at a side downstream from the first conveying means, for moving the sheet so as to press it against the regulating member while conveying the sheet, control means for controlling the first conveying means so as to shift a first sheet having a first width in a direction crossing the conveying direction, and so as not to shift a second sheet having a second width different from the first width, and a third conveying means for conveying the sheet conveyed by the second coveying means to the image forming means.

According to still another aspect, the present invention which achieves these objectives relates to a sheet conveying device comprising rollers for conveying a sheet in a predetermined conveying direction by rotating in predetermined directions of rotation, and then performing switchback conveyance of the sheet by conveying it in a direction opposite to the predetermined conveying direction by rotating in directions opposite to the predetermined directions of rotation, supporting means for supporting the rollers so as to be movable in the directions of rotation axes, and a helical gear, provided as one body with the rollers, for transmitting a driving force to the rollers. The rollers shift the sheet in a direction crossing the predetermined conveying direction by the driving force transmitted via the helical gear.

According to another aspect, the present invention which achieves these objectives relates to an image forming apparatus comprising image forming means for forming an image on a sheet, first conveying means comprising rollers for conveying the sheet having the image formed thereon by the image forming means in a predetermined conveying direction by rotating in predetermined directions of rotation, and then performing switchback conveyance of the sheet by conveying it in a direction opposite to the predetermined conveying direction by rotating in directions opposite to the predetermined directions of rotation, supporting means for supporting the rollers so as to be movable in the directions of rotation axes, and a helical gear, provided as one body with the rollers, for transmitting a driving force to the rollers. The rollers shift the sheet in a direction crossing the predetermined conveying direction by the drive transmitted via the helical gear. The apparatus further comprises a regulating member, disposed at a side downstream from the rollers, for regulating the position of a side end portion of the sheet conveyed by the rollers by contacting the side portion of the sheet, second conveying means, disposed at a side downstream from the rollers, for moving the sheet so as to press it against the regulating member while conveying the sheet, control means for controlling the first conveying means so as to shift a first sheet having a first width in a direction crossing the conveying direction, and so as not to shift a second sheet having a second width different from the first width, and third conveying means for conveying the sheet conveyed by the second coveying means to the image forming means.

According to still another aspect, the present invention which achieves these objectives relates to a sheet conveying device comprising first conveying means capable of conveying a sheet and shifting the sheet in a direction crossing a conveying direction, a first regulating member, disposed at a side downstream from the first conveying means, for regulating the position of a side portion of a first sheet having a first width conveyed by the conveying means by contacting the side portion of the first sheet, a second regulating member, disposed at a side downstream from the first conveying means, for regulating the position of a side portion of a second sheet having a second width larger than the first width conveyed by the conveying means by contacting the side portion of the sheet, second conveying means, disposed at a side downstream from the first conveying means, for moving the sheet so as to press it against the first or second regulating member while conveying the sheet.

The foregoing and other objects, advantages and features of the present invention will become more apparent from the following detailed description of the preferred emodiments taken in conjunction with the accompanying drawings.

DETAILED DESCRIPTION OF THE PREFERRED EMBODIMENTS

Preferred embodiments of the present invention will now be described with reference to the drawings.

First Embodiment

Figure 1:
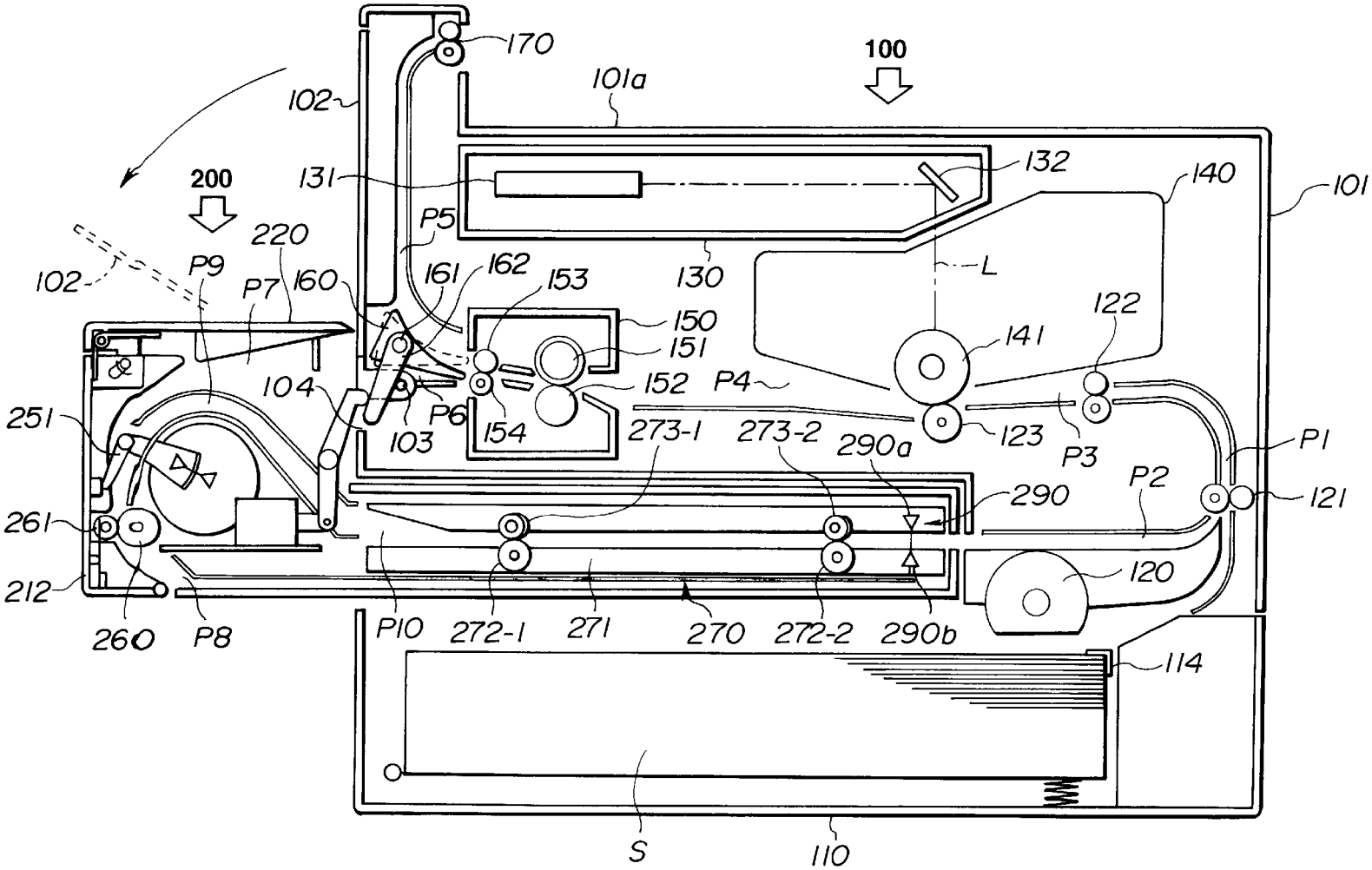
FIG. 1 is a vertical sectional side view illustrating the entire configuration of an image forming apparatus (a laser-beam printer) which mounts a sheet conveying device for duplex printing according to a first embodiment of the present invention.
Figure 4:
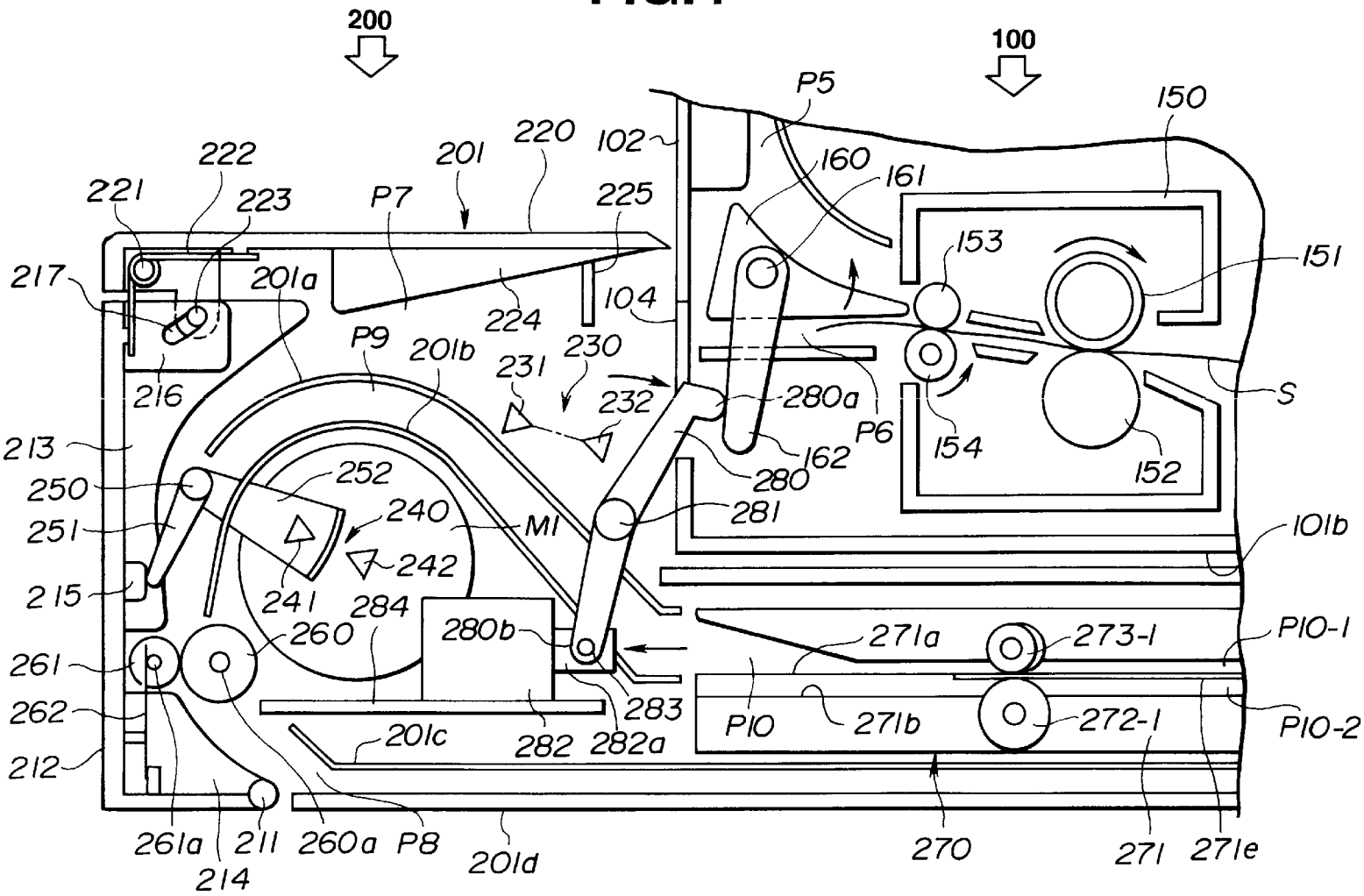
FIG. 4 is a vertical sectional side view illustrating the configuration of the sheet conveying device for duplex printing shown in FIG. 1.

FIG. 1 illustrates the entire configuration of an image forming apparatus (a laser-beam printer) which mounts a sheet conveying device for duplex printing acording to a first embodiment of the present invention. FIG. 4 illustrates the configuration of the sheet conveying device for duplex printing shown in FIG. 1.

An image forming apparatus 100 shown in FIG. 1 is configured for simplex printing such that only sheet conveying paths P1, P2, P3, P4, P5 and P6 for simplex printing are provided within a main body 101 of the apparatus. However, as shown in FIG. 1, by mounting a sheet conveying device 200 for duplex printing at a predetermined position of the main body 101 of the apparatus, duplex printing can be performed.

The entire configuration of the image forming apparatus 100 will now be described with respect to the flow of a recording sheet during a simplex printing mode wherein the optional sheet conveying device 200 for duplex printing is not mounted.

A sheet feeding cassette 110 is disposed at the lower-most portion of the main body 101 of the apparatus. Recording sheets S accommodated within the sheet feeding cassette 110 are individually fed toward a transfer portion.

The recording sheets S accommodated within the sheet feeding cassette 110 are sequentially fed from the uppermost sheet by a semicircular feeding roller 120 which performs one revolution in a counterclockwise direction in FIG. 1. Only the uppermost sheet of the recording sheets S fed by the feeding roller 120 is separated by a separation pawl 114.

The recording sheet S fed by the feeding roller 120 passes through the path P1 and reaches a pair of registration rollers 122 which is in a state of stopping their rotation. At that time, a pair of conveying rollers 121 conveys the recording sheet S.

The pair of conveying rollers 121 temporarily stop their rotation when the leading edge of the recording sheet S contacts a nip formed between the pair of registration rollers 122 and a loop having a predetermined amount is formed in the recording sheet S. A skewed state of the recording sheet S is corrected by this loop.

The recording sheet S whose skewed state has been corrected is conveyed to a transfer portion provided between a photosensitive drum 141 and a transfer roller 123 by the pair of registration rollers 122 which start to rotate at the timing of adjusting the position of a toner image on the photosensitive drum 141 rotating in a clockwise direction in FIG. 1 to the position of the leading edge of the recording sheet S within a process unit 140. At that time, the recording sheet S passes through the path P3. The toner image on the photosensitive drum 141 rotating in the clockwise direction is sequentially transferred onto the surface of the recording sheet S conveyed to the transfer portion.

Laser light L emitted from a laser scanner unit 130 is projected onto the photosensitive drum 141 rotating in the clockwise direction. Thus, an electrostatic latent image is sequentially formed on the photosensitive drum 141, and the formed latent image is converted into a visible image by a toner supplied from a deveoping device (not shown).

The recording sheet S having a toner image transferred thereon which is conveyed by the photosensitive drum 141 and the transfer roller 123 passes through the path P4 and reaches a fixing device 150. The transferred toner image is fixed on the surface of the recording sheet S by being heated and pressed while the recording sheet S passes through a nip formed between a fixing roller 151 and a pressing roller 152.

The recording sheet S after the processing of fixing the toner image by the fixing device 150 has been completed is discharged out of the apparatus. In this image forming apparatus 100, two kinds of sheet discharging modes can be selected. In one mode, a face-down sheet discharging operation in which the sheet is discharged with the surface having the toner image facing down is performed. In another mode, a face-up sheet discharging operation in which the sheet is discharged with the surface having the toner image facing up is perforned.

For example, when peforming a face-down sheet discharging operation, a discharged-sheet tray 102 openable/closable around a supporting shaft 103 is closed as indicated by solid lines in FIG. 1, to set a flapper 160 to a position indicated by solid lines so as to open the path P5. In this state, the recording sheet S conveyed by a pair of sheet discharging rollers 153 and 154 passes through the path P5 and is discharged out of the apparatus by a pair of sheet discharging rollers 170, and is mounted onto a discharged-sheet tray 101a formed on the upper surface of the main body 101 of the apparatus.

When performing a face-up sheet discharging operation, the discharging-sheet tray 102 is opened as indicated by broken lines, to set the flapper 160 to a position indicated by broken lines so as to open the path P6. In this state, the recording sheet S conveyed by the pair of sheet discharging rollers 153 and 154 passes through the path P6 and is discharged out of the apparatus via a dicharging port 104, and is mounted onto the discharged-sheet tray 102.

The set position of the flapper 160 for opening/closing the paths P5 and P6 automatically changes linked with the opening/closing operation of the discharged-sheet tray 102. That is, when the discharged-sheet tray 102 which is closed is opened to the position indicated by the broken lines, the flapper 160 set to the position indicated by the solid lines is set to the position indicated by the broken lines by rotating around a supporting shaft 161 in a counterclockwise direction. In this case, the flapper 160 is always urged in a clockwise direction by a spring or the like (not shown). On the other hand, when the discharged-sheet tray 102 which is opened is closed as indicated by the solid lines, the flapper 160 set to the position indicated by the broken lines is set to the position indicated by the solid lines by rotating in a clockwise direction by the urging force of the spring or the like.

When performing duplex printing in this image forming apparatus 100, as shown in FIG. 1, the sheet conveying device 200 for duplex printing of the present embodiment is mounted at a predetermined position of the main body 101 of the apparatus. At that time, a part of a main body 201 of the sheet conveying device is inserted into a space portion 101*b* of the main body 101 of the apparatus formed between the fixing device 150 and the sheet feeding cassette 110 (see FIG. 4). By thus inserting the part of the main body 201 of the sheet conveying device into the space portion 101*b*, the sheet conveying device 200 for duplex printing is automatically locked relative to the main body 101 of the apparatus. When the sheet conveying device 200 for duplex printing is drawn by a certain amount of force, the locked state is released.

When mounting the sheet conveying device 200 for duplex printing of the first embodiment in the main body 101 of the apparatus, the discharged-sheet tray 102 must be closed. Accordingly, in the image forming apparatus 100 in a state in which duplex printing can be performed, the recording sheet S cannot be discharged onto the discharged-sheet tray 102 for the face-up sheet discharging operation. Instead, the recording sheet S after a printing operation is discharged onto the discharged-sheet tray 101*a* for the face-down sheet discharging operation.

Next, a description will be provided of the configuration of the sheet conveying device 200 for duplex printing of the first embodiment with reference to FIGS. 1 and 4.

The sheet conveying device 200 for duplex printing includes flapper switching means capable of automatically changing the set position of the flapper 160 within the main body 101 of the apparatus. The flapper switching means comprises a lever member 280 capable of rotating around a supporting shaft 281, and a solenoid 282 whose plunger 282*a* retracts in the direction of the arrow when the solenoid 282 is turned on. One end (a cam follower) 280*a* of the lever member 280 contacts a cam member 162 fixed on the supporting shaft 161 of the flapper 160. Another end 280*b* of the lever member 280 is connected to a distal-end portion of the plunger 282*a* in the form of a link by a connecting shaft 283.

When the solenoid 282 is turned on to retract the plunger 282*a*, the lever member 280 rotates around the supporting shaft 281 in a clockwise direction, so that the cam follower 280*a* presses the cam member 162. Thus, the cam member 162 rotates in a counterclockwise direction, so that, as shown in FIG. 4, the flapper 160 is set to the position to open the path P6. When performing duplex printing, the flapper 160 is first set to this position so that the sheet S having a printed image on its first surface can enter the sheet conveying device 200 for duplex printing.

When the solenoid 282 is turned off to extend the plunger 282*a*, the lever member 280 rotates around the supporting shaft 281 in a counterclockwise direction, to release the pressing force of the cam follower 280*a*. Thus, the cam member 162 rotates in a clockwise direction, and, as shown by the solid lines in FIG. 1, the flapper 160 is set to the position to open the path P5. In duplex printing, After the sheet S having the printed image on its first surface has passed through the path P6, the flapper 160 is set to this position so that the sheet having a printed image on its second surface can pass through the path P5. In simplex printing, the flapper 160 is always set to this position.

The sheet conveying device 200 for duplex printing includes the switchback conveying means (sheet conveying means) 260 and 261 for conveying the sheet S having the printed image on its first surface discharged from the discharging port 104 of the main body 101 of the apparatus into the main body 101 of the apparatus while reversing the surface of the sheet S. The switchback conveying means 260 and 261 perform reversal of the surface of the sheet S having the printed image on its first surface by performing switchback conveyance of the sheet S after performing ordinary conveyance of the sheet S. A conveying roller 260 can rotate in forward and reverse directions by acquiring a driving force from a motor M1. A conveying driven roller 261 performs driven rotation by contacting the conveying roller 260. The conveying rollers 260 and 261 grasp and convey the sheet S having the printed image on its first surface. The conveying roller 261 contacts the conveying roller 260 with a predetermined pressure by the urging force of a spring 262. The conveying roller 260 is mounted on the main body 201 of the sheet coveying device, and the conveying roller 261 is mounted on an opening/closing cover 212.

The sheet S having the printed image on its first surface discharged from the discharging port 104 of the main body 101 of the apparatus reaches the conveying roller 260 via a path P7, and the leading edge of the sheet S enters a nip formed between the conveying rollers 260 and 261.

A flapper 251 for reversal is provided at a portion upstream from the conveying roller 260. As shown in FIG. 4, the flapper 251 usually closes a downstream portion of the path P7. In this state, the flapper 251 rotates around a supporting shaft 250 in a clockwise direction by its own weight, and contacts a positioning member 215 provided on the cover member 212. When a side 251*a* of the flapper 251 is pressed by the leading edge of the sheet S having the printed image on its first surface moving toward the downstream side, the flapper 251 rotates around the supporting shaft 250 in a counterclockwise direction to open the path P7 and thereby pass the sheet S, as shown in FIG. 5.

Figure 5:
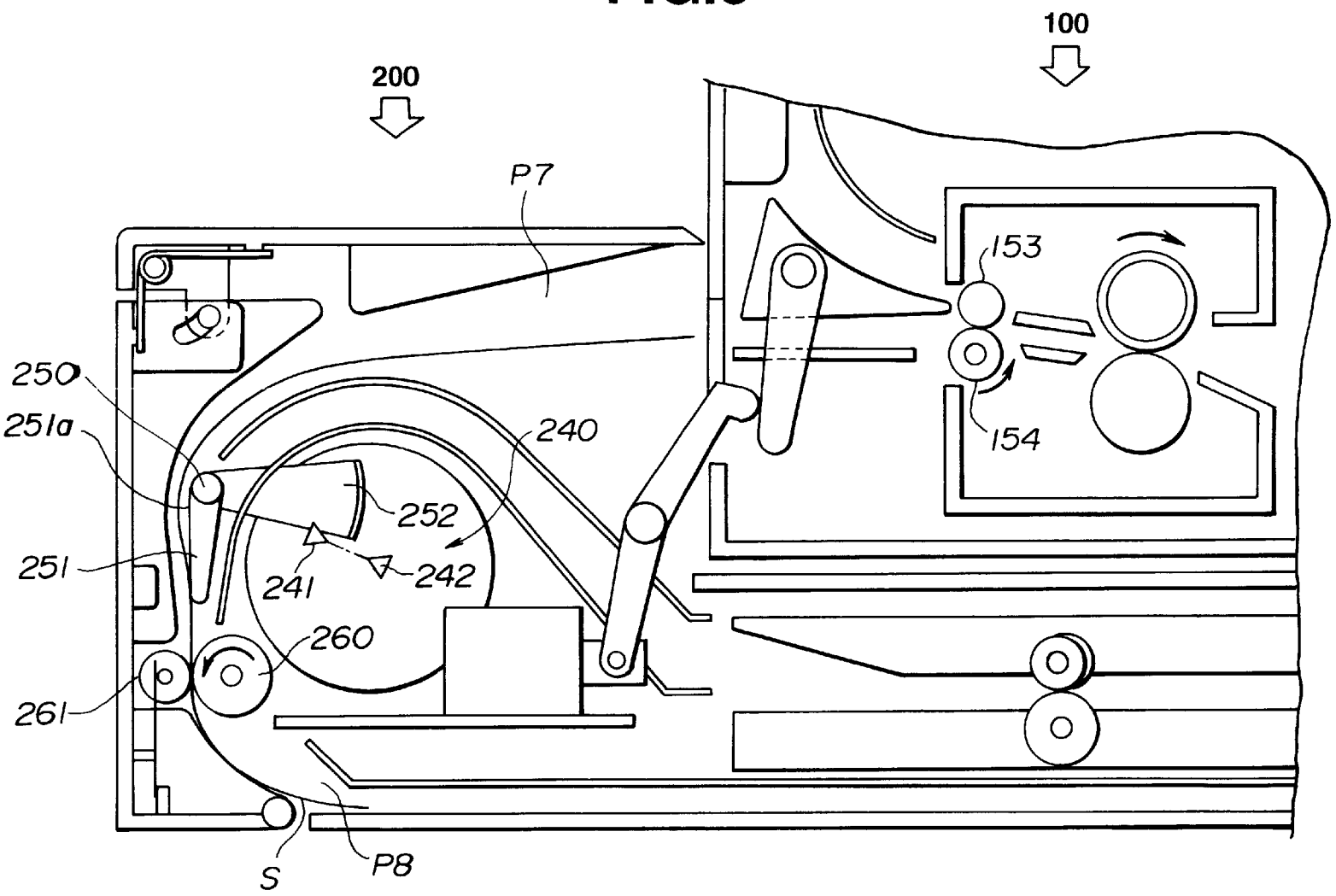
FIG. 5 is a vertical sectional side view illustrating a state in which a sheet having a printed image formed on its first surface moves within the sheet conveying device for duplex printing shown in FIG. 1.

As shown in FIG. 5, when the flapper 251 opens the path P7, a light-blocking member 252 linked with the rotation of the flapper 251 is separated from the optical path (between a light-emitting unit 241 and a photosensing unit 242) of a photo-interrupter 240 to turn on the photo-interrtupter 240. Thus, it is possible to detect that the sheet S having the printed image on its first surface is passing through the flapper 251. When the flapper 251 changes from the state of opening the path P7 to a state of closing the path P7, the light-blocking member 252 blocks the optical path of the photo-interrupter 240, to turn off the photo-interrupter 240. Thus, it is possible to detect that the trailing edge of the sheet S having the printed image on its first surface has passed through the flapper 251.

The conveying roller 260 performs ordinary conveyance of the sheet S having the printed image on its first surface by rotating in a counterclockwise direction. The sheet S having the printed image on its first surface moving toward the downstream side enters a path P8 by this ordinary conveyance. At that time, the conveying speed of the conveying roller 260 is arranged to have the same value as the conveying speed of the pair of sheet discharging rollers 153 and 154. FIG. 5 illustrates the sheet S having the printed image on its first surface subjected to ordinary conveyance by the conveying roller 260. The conveying speed of the conveying roller 260 may be higher than the conveying speed of the pair of sheet discharging rollers 153 and 154.

Figure 6:
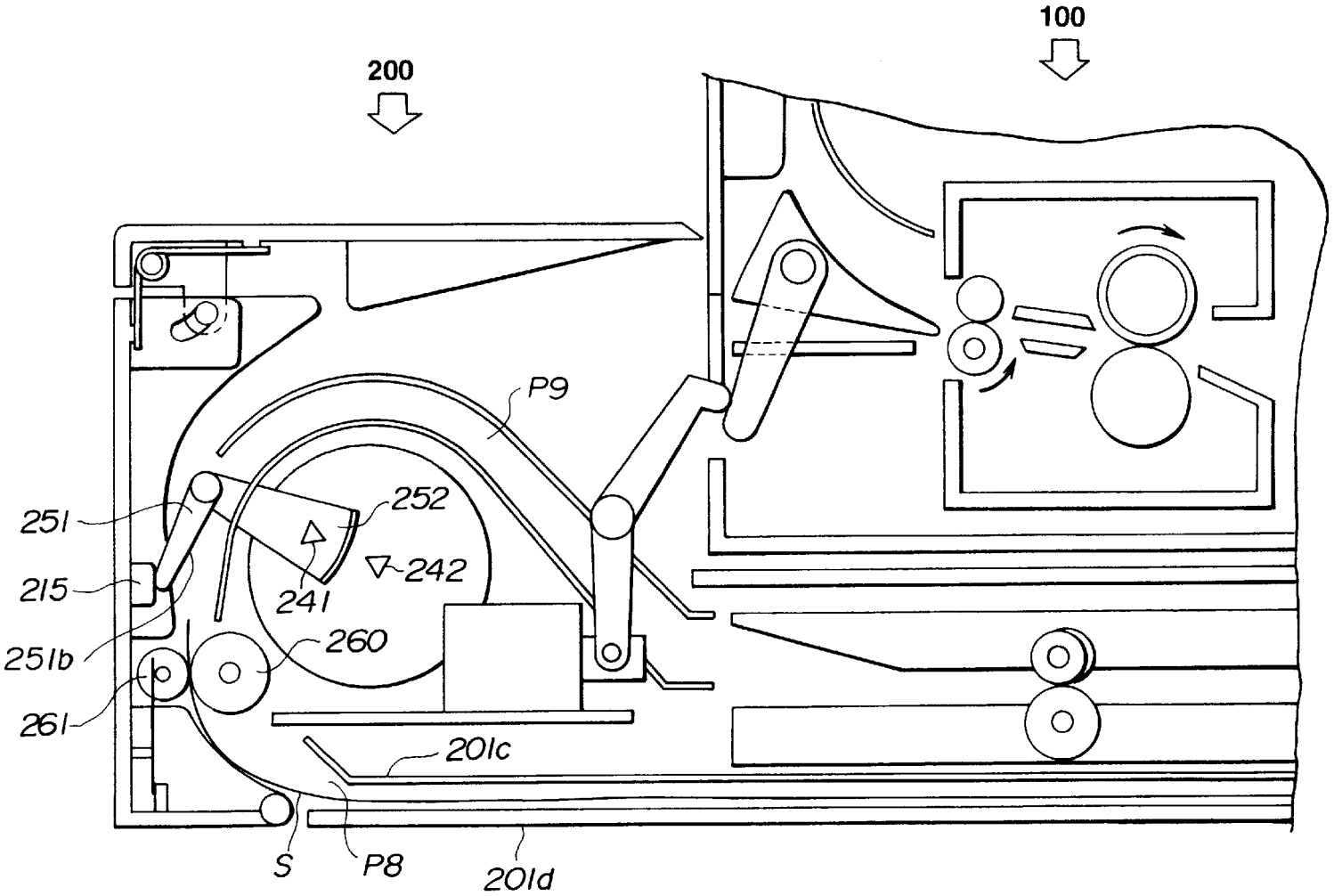
FIG. 6 is a vertical sectional front view illustrating the configuration, the operation and the function of a final conveying path portion of the sheet conveying device for duplex printing shown in FIG. 1.

After the trailing edge of the sheet S has passed through the flapper 251 (at that time, the photo-interrupter 240 is turned off, and the flapper 251 closes the path P7), the conveying roller 260 rotates in a clockwise direction to perform switchback conveyance of the sheet S having the printed image on its first surface. FIG. 6 illustrates the sheet S having the printed image on its first surface for which switchback conveyance is started. The switchbacked sheet S having the printed image on its first surface enters a path P9 for reversal while being guided by a side 251*b* of the flapper 251 closing the path P7, and travels toward the downstream side. By passage of the sheet S having the printed image on its first surface through the path P9, the surface of the sheet S is reversed.

Figure 7:
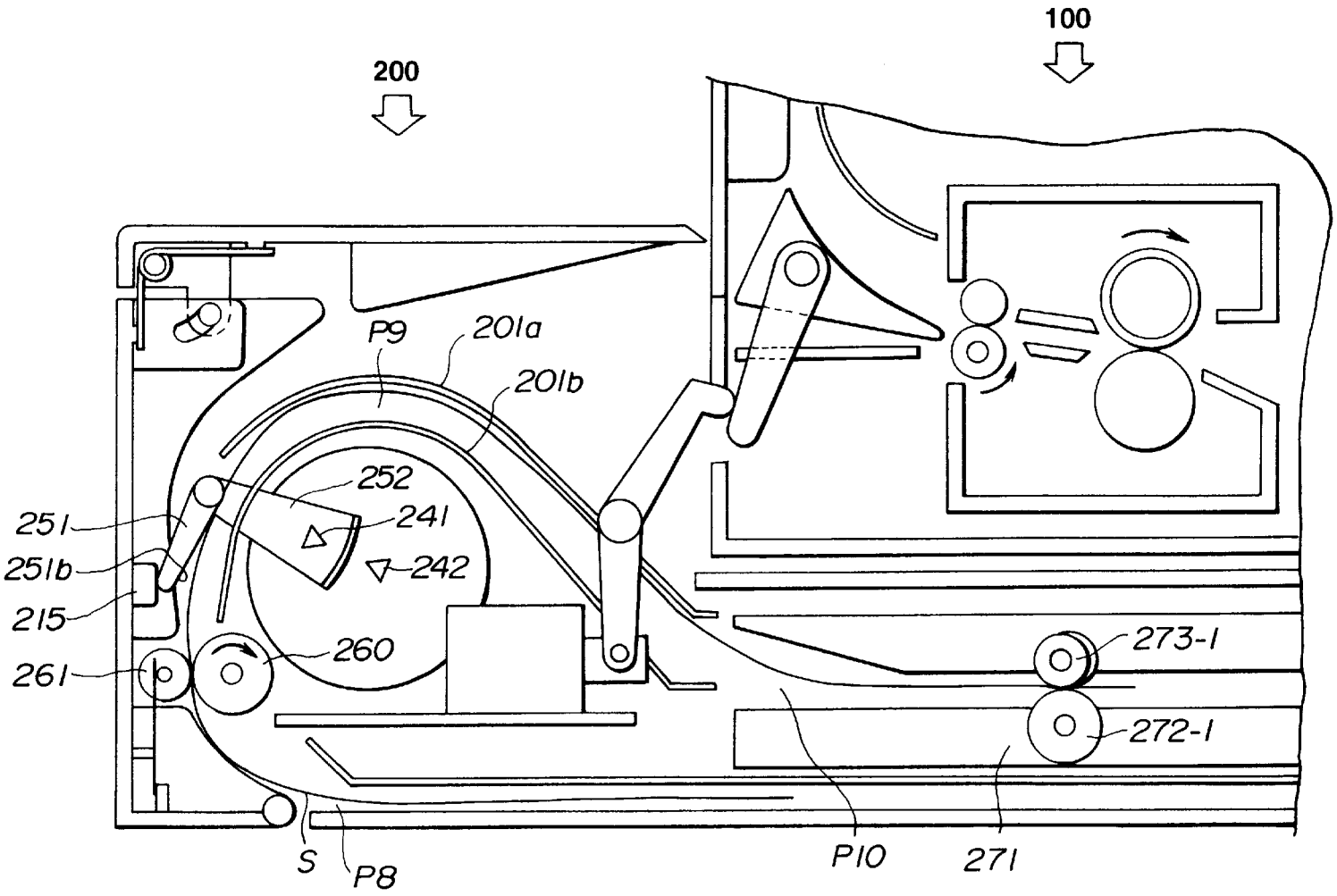
FIG. 7 is a vertical sectional side view illustrating a state in which a sheet having a printed image formed on its first surface moves within the sheet conveying device for duplex printing shown in FIG. 1.

As shown in FIG. 7, the sheet S having the printed image on its first surface switchbacked and passed through the path P9 passes through a path P10 within a main body 271 of a regulating device (regulating unit) (the passage is detected by a photo-interrupter 290), enters the path P1 after passing through the path P2, and is conveyed to the pair of registration rollers 122 which is in a state of stopping their rotation. Thereafter, the sheet S having the printed image on its first surface, whose surface has been reversed by the sheet conveying device 200 for duplex printing, is conveyed in the same manner as in printing on the first surface, i.e., the sheet S passes through the processes of printing on its second surface and fixing of the toner image formed on the second surface, and is discharged onto the discharged-sheet tray 101*a* provided outside the apparatus by the pair of sheet discharging rollers 170 (see FIG. 1).

Figure 2A:
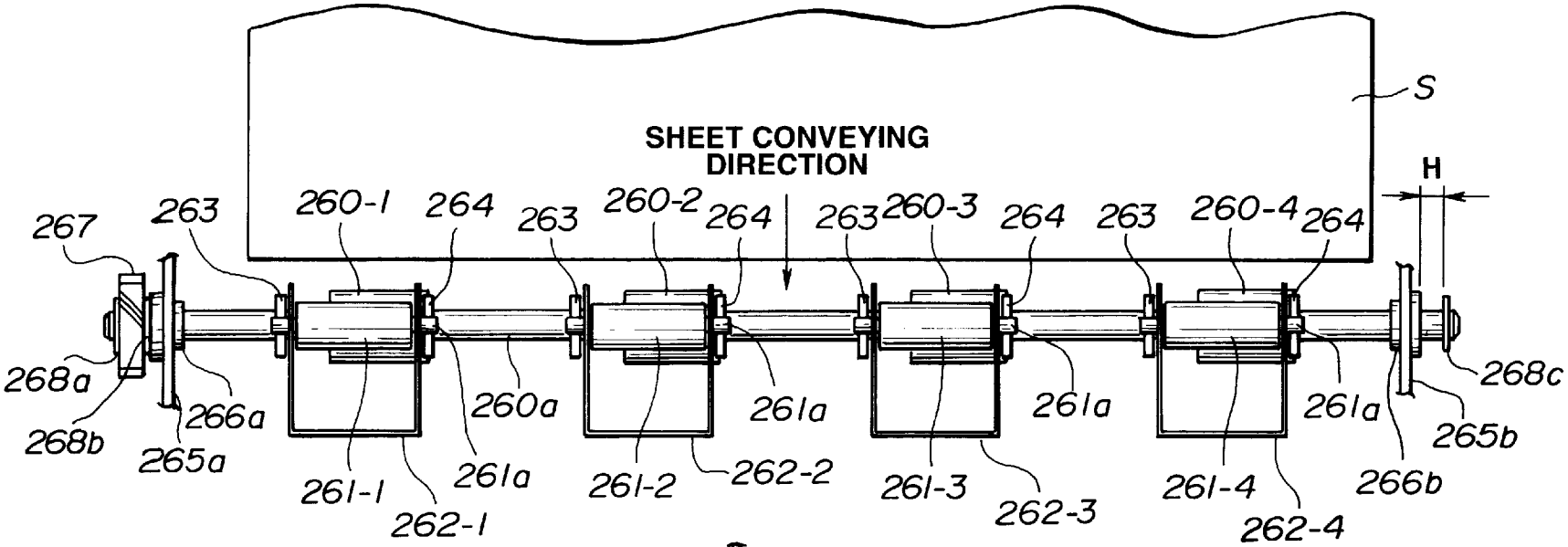
FIGS. 2(*a*) and 2(*b*) are a front view and a vertical sectional side view, respectively, illustrating the configuration of switchback conveying means in the sheet conveying device for duplex printing shown in FIG. 1.
Figure 2B:
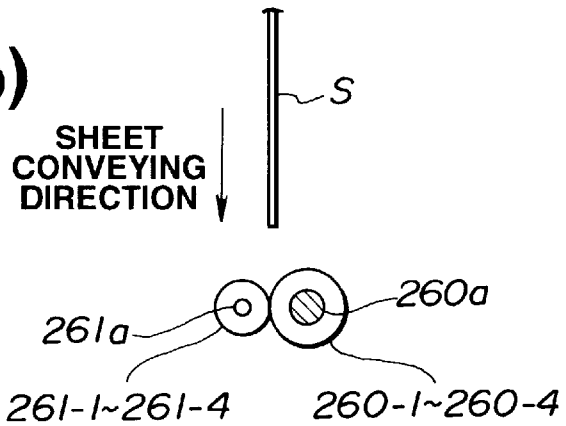

FIGS. 2(*a*) and 2(*b*) illustrate the detailed configuration of the switchback conveying means (comprising the conveying rollers 260 and 261). FTG. 2(*a*) is a front view as seen from the left of FIG. 4.

The conveying roller 260 comprises a plurality of rollers 260-1–260-4 arranged at a predetermined interval in the lateral direction or the sheet. Driven rollers 261-1–261-4 contact. the rollers 260-1–260-4 by being urged by springs 262-1–262-4, respectively. A shaft 261*a* of the driven rollers 261-1–261-4 are rotatably mounted on (position-fixing) supporting plates 263 and 264 provided on the cover member 212.

A shaft 260*a* of the rollers 260-1–260-4 is rotatably and slidably mounted on supporting members 265*a* and 265*b* via corresponding bearings 266*a* and 266*b*. The driving force of the motor M1 is transmitted to the shaft 260*a* via a helical gear 267. The helical gear 267 is nonrotatably fitted on the shaft 260*a*, and cannot slide on the shaft 260*a* due to regulating members 268*a* and 268*b*.

FIG. 2(*a*) illustrates the set positions of the rollers 260-1–260-4 in ordinary conveyance. In this state, the rollers 260-1–260-4 are positioned at the right of the driven rollers 261-1–261-4, and a regulating member 268*c* is provided at a position separated from the bearing 266*b* by a distance H. This position is a home position of the rollers 260-1–260-4.

Figure 8A:
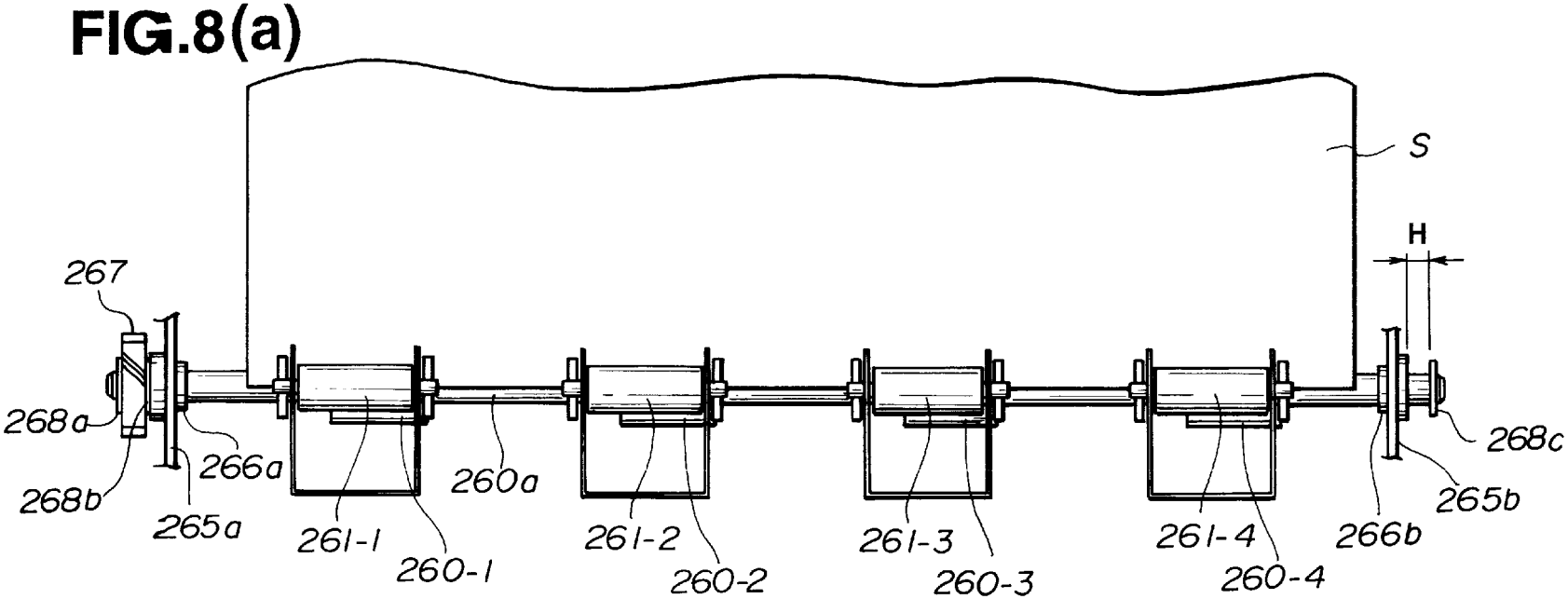
FIGS. 8(*a*) through 12(*a*) and 8(*b*) through 12(*b*) are front views and vertical sectional side views, respectively, illustrating operations when the switchback conveying means conveys an LTR (letter)-size sheet.
Figure 8B:
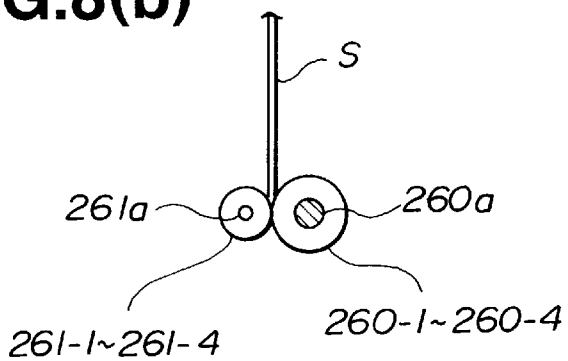

Next, a description will be provided of the operation and the function of the switchback conveying means 260 and 261 with reference to FIGS. 8(*a*) and 8(*b*) through 18(*a*) and 18(*b*).

A description will be provided assuming that two kinds of sheets of different width sizes (the LTR size and the A4 size) are used in the image forming apparatus 100.

When conveying a LTR-size sheet having a larger width, the switchback conveying means 260 and 261 operate in the sequence of FIGS. 8(*a*) and 8(*b*) through 12(*a*) and 12(*b*).

Figure 9:
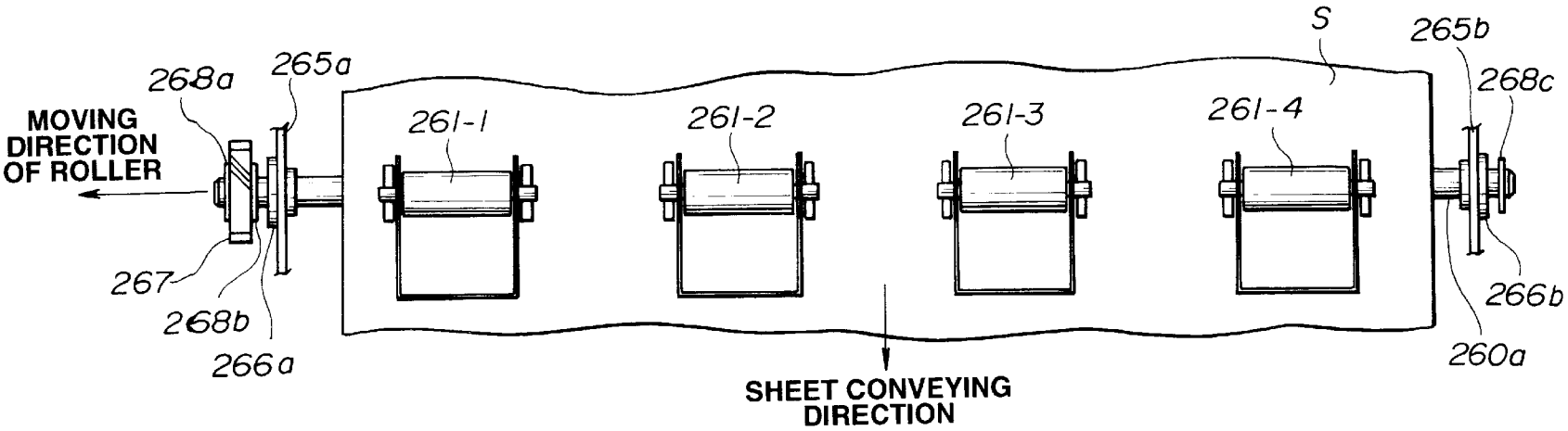
Figure 9B:
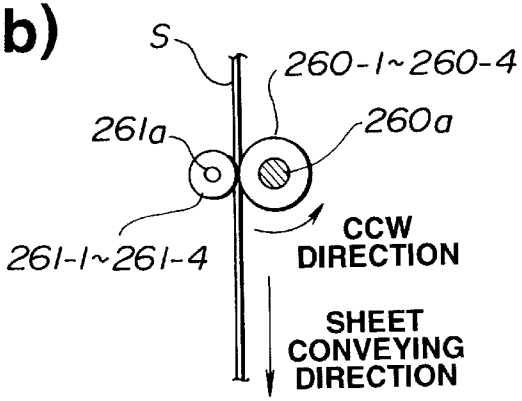

When the leading edge of the sheet S contacts the nip portion as shown in FIGS. 8(*a*) and 8(*b*), the sheet S is grasped and conveyed by the switchback conveying means 260 and 261 as shown in FIGS. 9(*a*) and 9(*b*). At that time, the roller shaft 260*a* moves toward the direction of the arrow (toward the left) due to the function of the helix angle of the helical gear 267. Accordingly, the sheet S grasped by the switchback conveying means 260 and 261 is conveyed into the path P8 while moving in the direction of the arrow (toward the left).

Figure 10A:
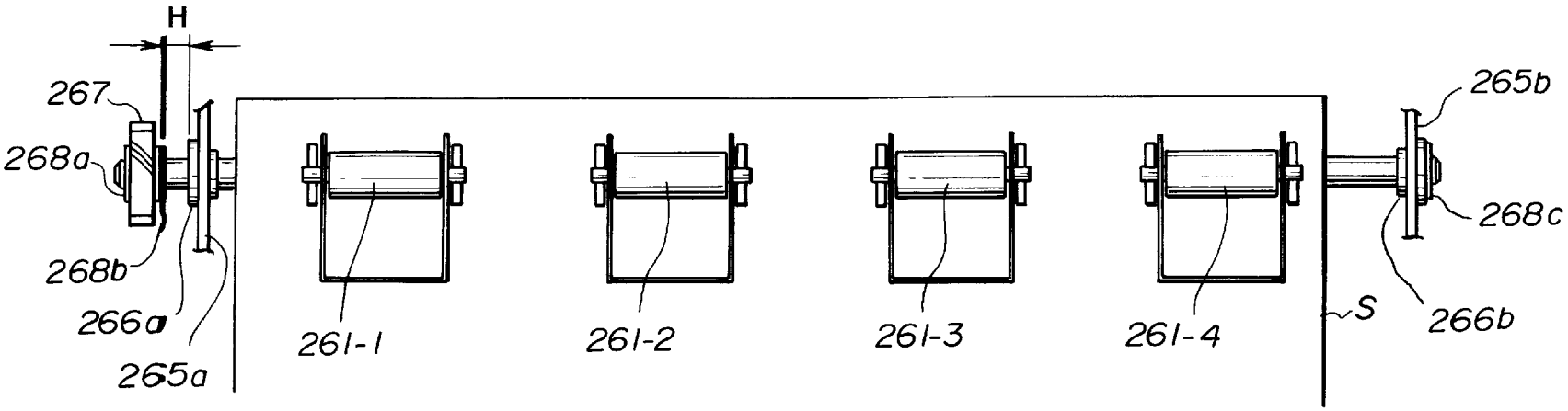
Figure 10B:
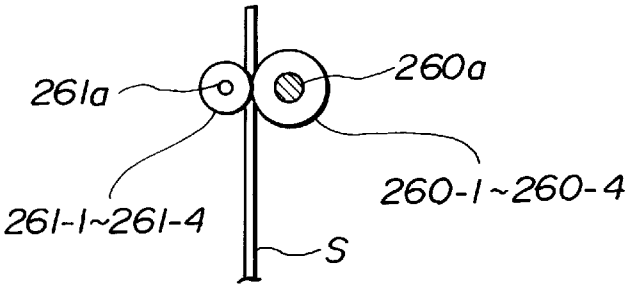

As shown in FIGS. 10(*a*) and 10(*b*), before the trailing edge of the sheet S is detected by the photo-interrupter 240, and the drive of the motor M1 stops, the roller shaft 260*a* waits in a state in which the regulating member 268*c* contacts the bearing 266*b*. At that time, the conveying roller 260 moves from the home position by the distance H together with the sheet S to be conveyed into the path P8.

Figure 11A:
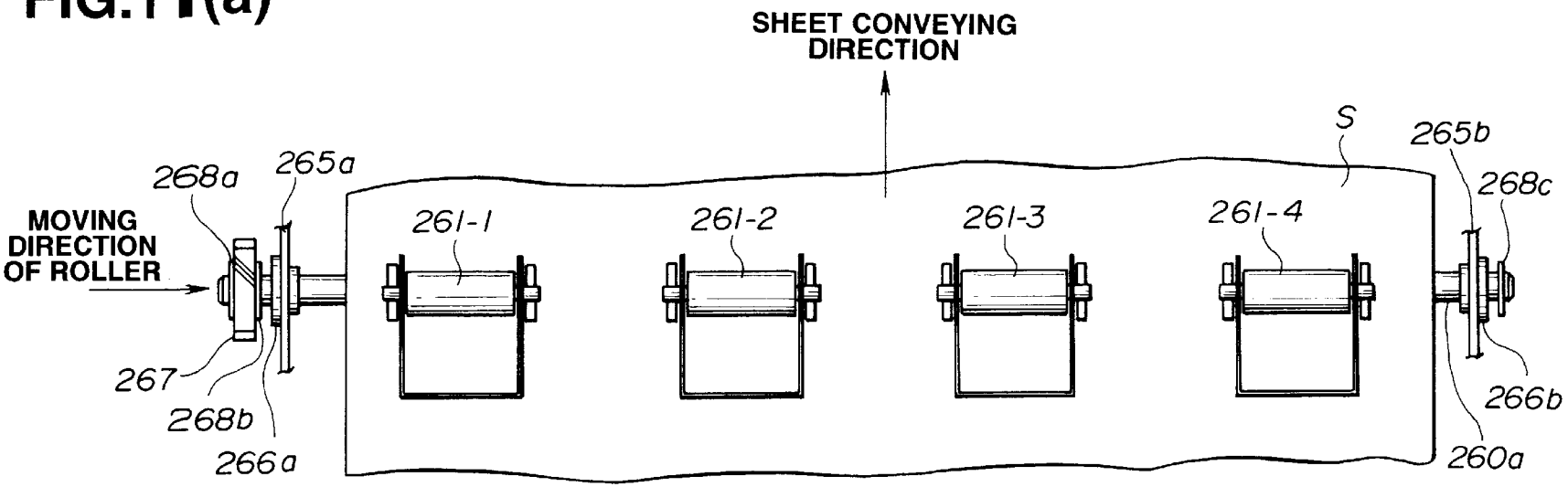
Figure 11B:
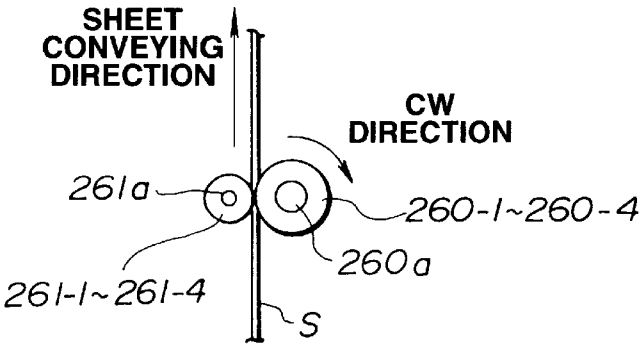
Figure 12A:
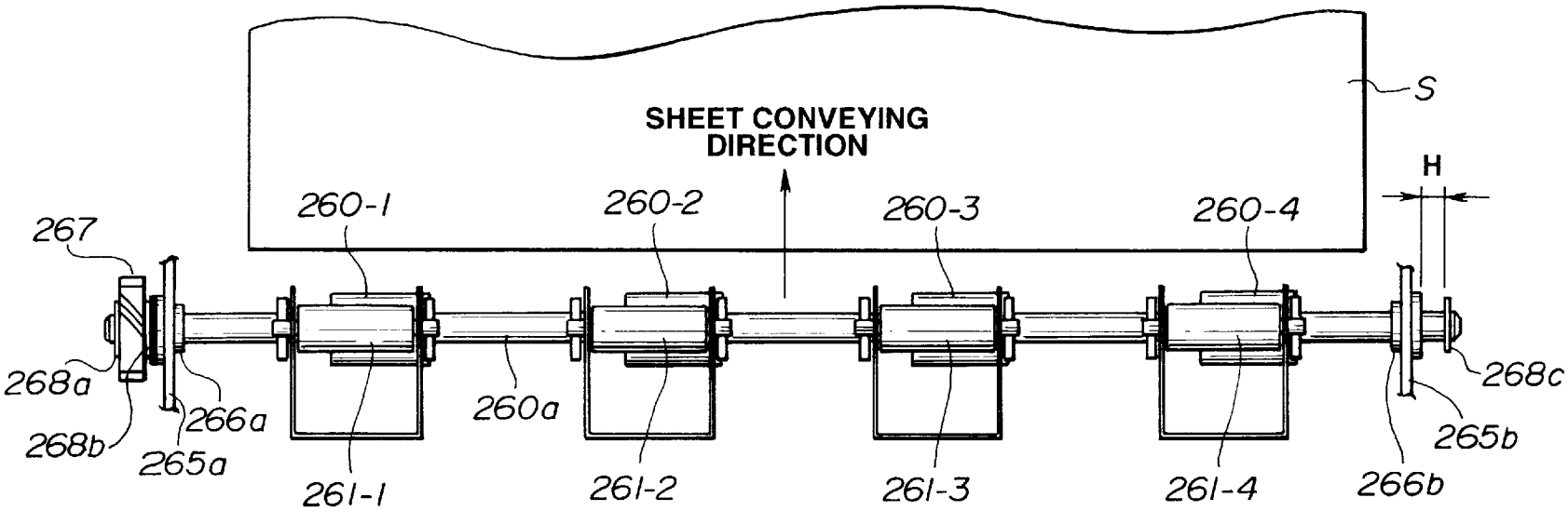
Figure 12B:
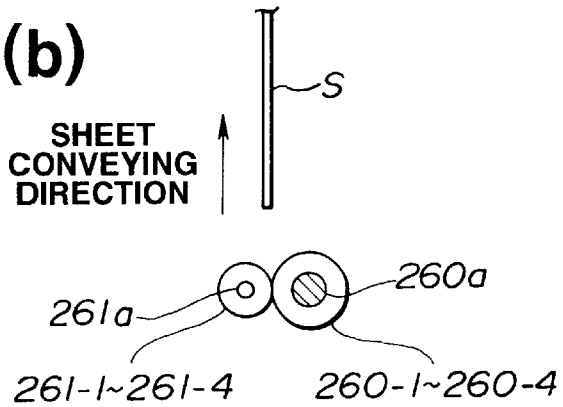

When the motor M1 is driven in a reverse direction to perform switchback conveyance of the sheet S as shown in FIGS. 11(*a*) and 11(*b*), the roller shaft 260*a* moves in the direction of the arrow (toward the right), which is opposite to the above-described direction, due to the function of the helix angle of the helical gear 267. As shown in FIGS. 12(*a*) and 12(*b*), before the leading edge of the sheet S subjected to switchback conveyance is grasped by refeeding means 272-1 and 273-1 provided at an upstream portion of the regulating member 270, the regulating member 268*b* of the roller shaft 260*a* contacts the bearing 266*a*. At that time, the conveying roller 260 is placed at a position equal to the home position (see FIGS. 2(*a*) and 2(*b*)) together with the sheet S. That is, there is substantially no difference between the position of the sheet S in the lateral direction when the sheet S is discharged from the main body 101 of the apparatus present at the upstream side and the position of the sheet S in the lateral direction when the sheet S enters the refeeding means present at the downstream side. This situation will be termed a "first mode".

When the leading edge of the sheet S contacts the nip between the pair of conveying rollers 260 and 261 as shown in FIGS. 8(*a*) and 8(*b*), it is desirable that the pair of conveying rollers 260 and 261 is in a state of stopping at the home position. After the leading edge of the sheet S forms a loop by contacting the pair of conveying rollers 260 and 261 which stop, the pair of conveying rollers 260 and 261 start conveyance of the sheet S.

Since the pair of conveying rollers 260 and 261 stop, the shift of the sheet S can be started from the home position, so that a correct amount of shift can be assured.

Figure 13A:
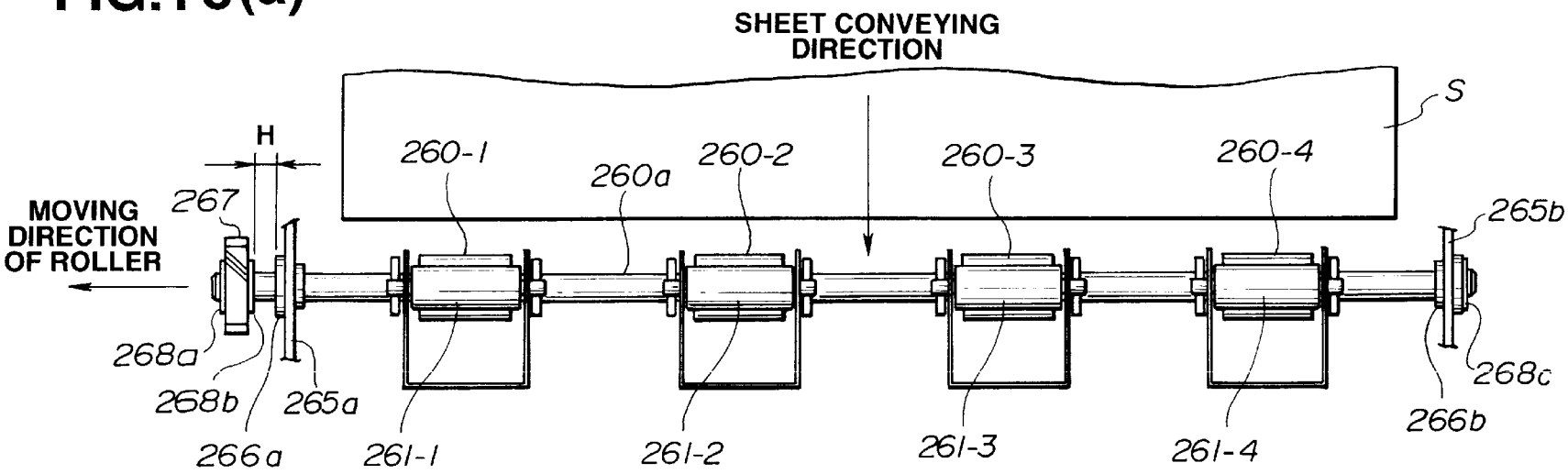
FIGS. 13(*a*) through 18(*a*) and 13(*b*) through 18(*b*) are front views and vertical sectional side views, respectively, illustrating operations when the switchback conveying means conveys an A4-size sheet.
Figure 13B:
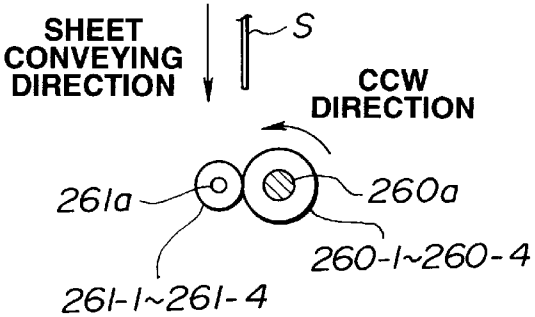

When conveying an A4-size sheet having a smaller width, the switchback conveying means 260 and 261 operate in the sequence of FIGS. 13(*a*) and 13(*b*) through 18(*a*) and 18(*b*).

As shown in FIGS. 13(*a*) and 13(*b*), before the sheet S having the printed image on its first surface contacts the nip portion between the switchback conveying means 260 and 261 at the end of switchback conveyance, the conveying roller 260 is rotated in advance in a counterclockwise direction which is opposite to the direction of rotation during the switchback conveyance, and stops and waits in a state in which the regulating member 268*c* contacts the bearing 266*b*.

Figure 14A:
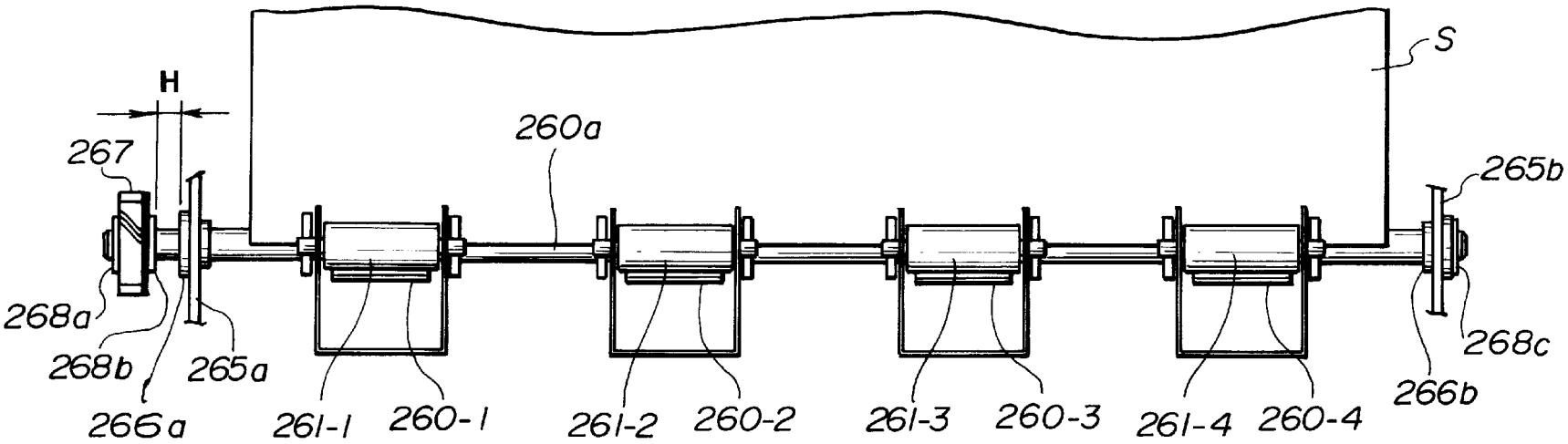
Figure 14B:
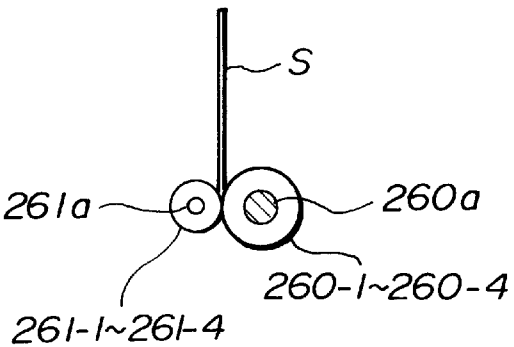
Figure 15A:
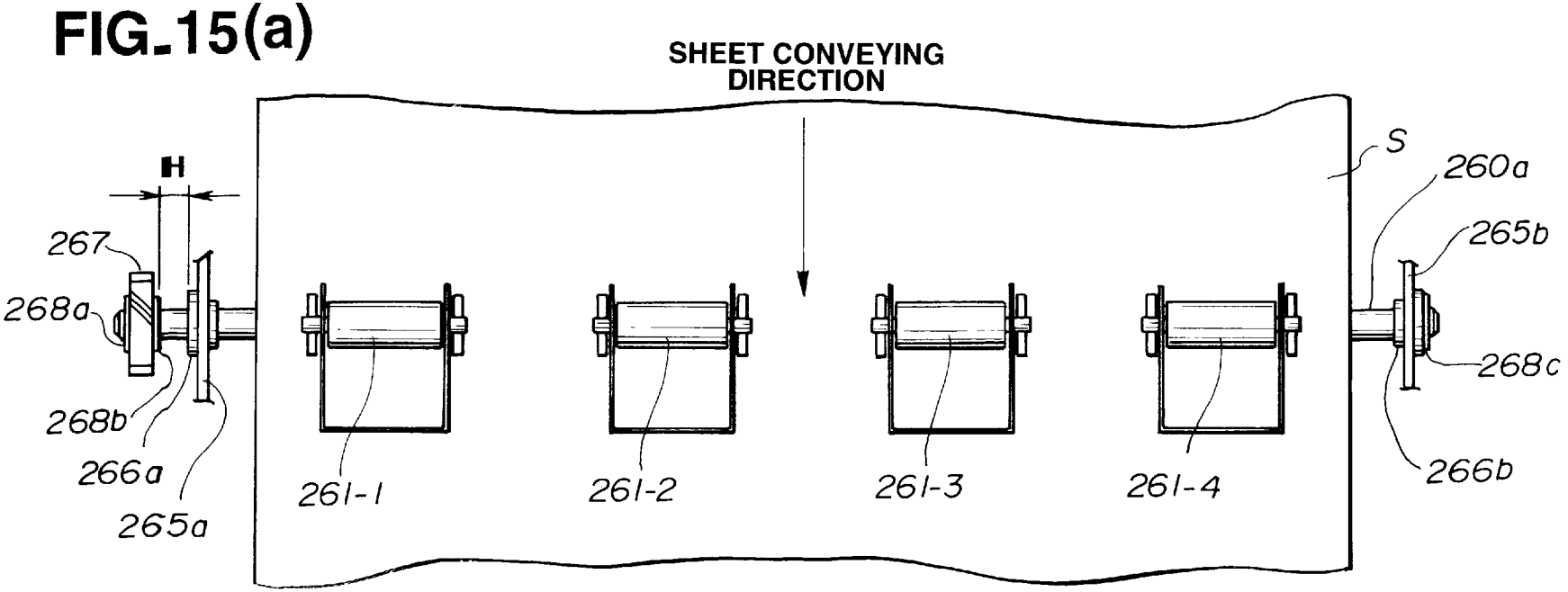
Figure 15B:
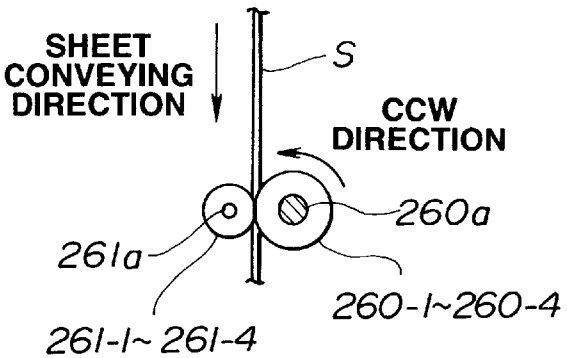
Figure 16A:
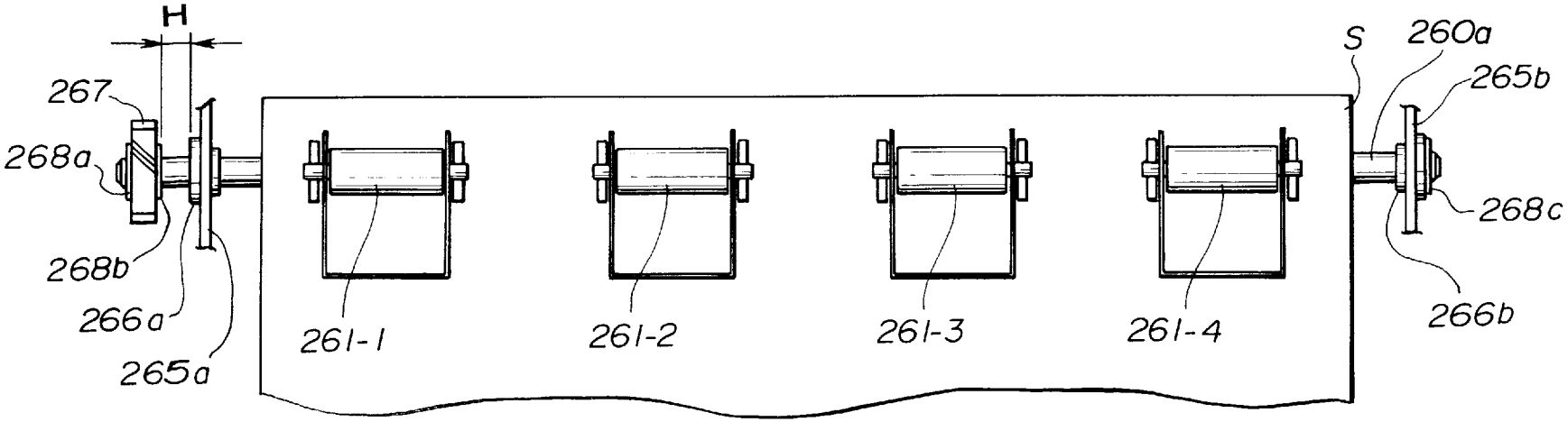
Figure 16B:
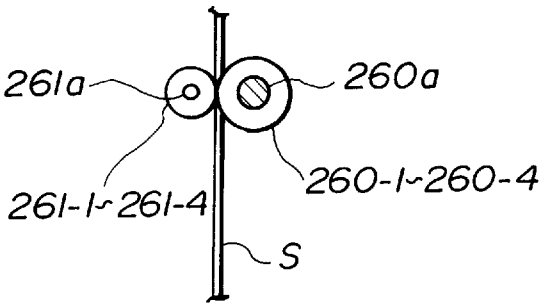

After the leading edge of the sheet S having the printed image on its first surface forms a loop by contacting the nip portion between the switchback conveying means 260 and 261 as shown in FIGS. 14(*a*) and 14(*b*), the sheet S is grasped and conveyed by the switchback conveying means 260 and 261 as shown in FIG. 15(*a*) and 15(*b*). However, since the regulating member 268*c* already contacts the bearing 266*b*, the conveying roller 260 cannot. move further, and, as shown in FIGS. 16(*a*) and 16(*b*), the sheet S moves straight and is conveyed into a path P18.

Figure 17A:
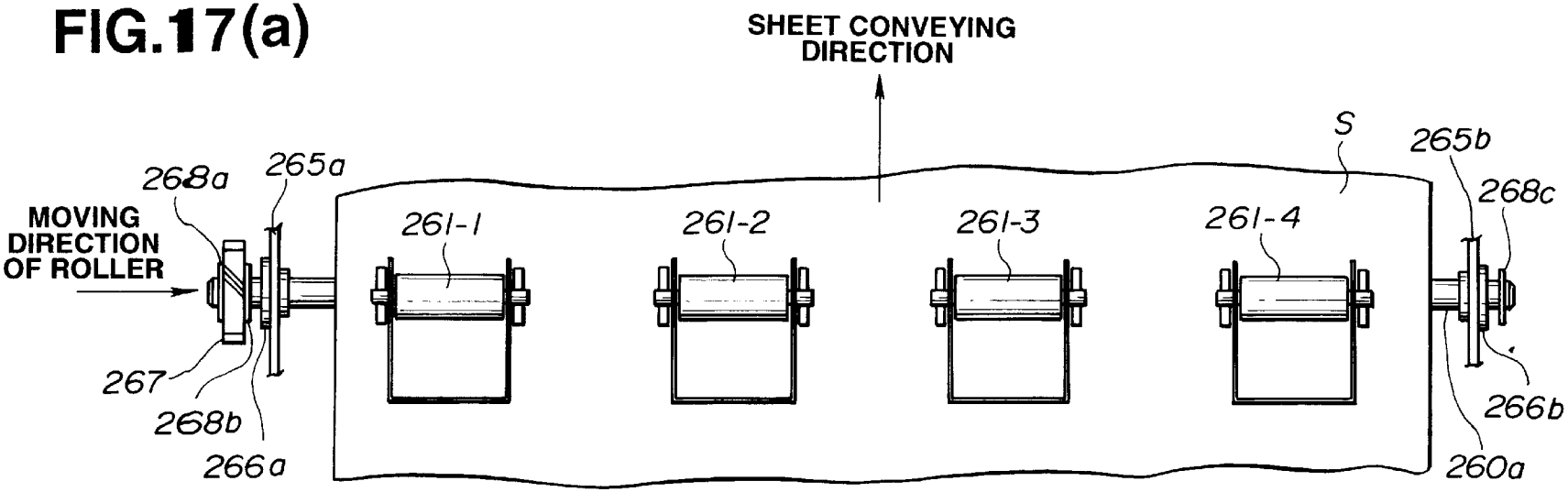
Figure 17B:
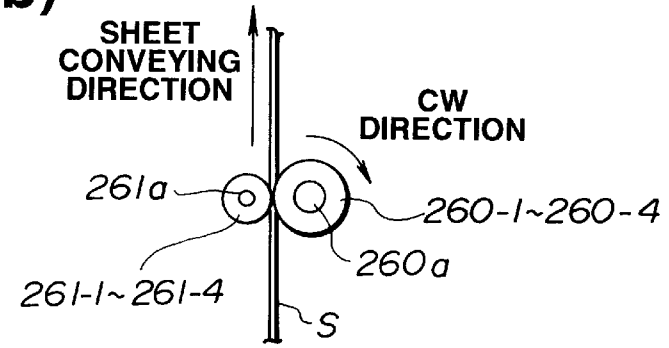
Figure 18A:
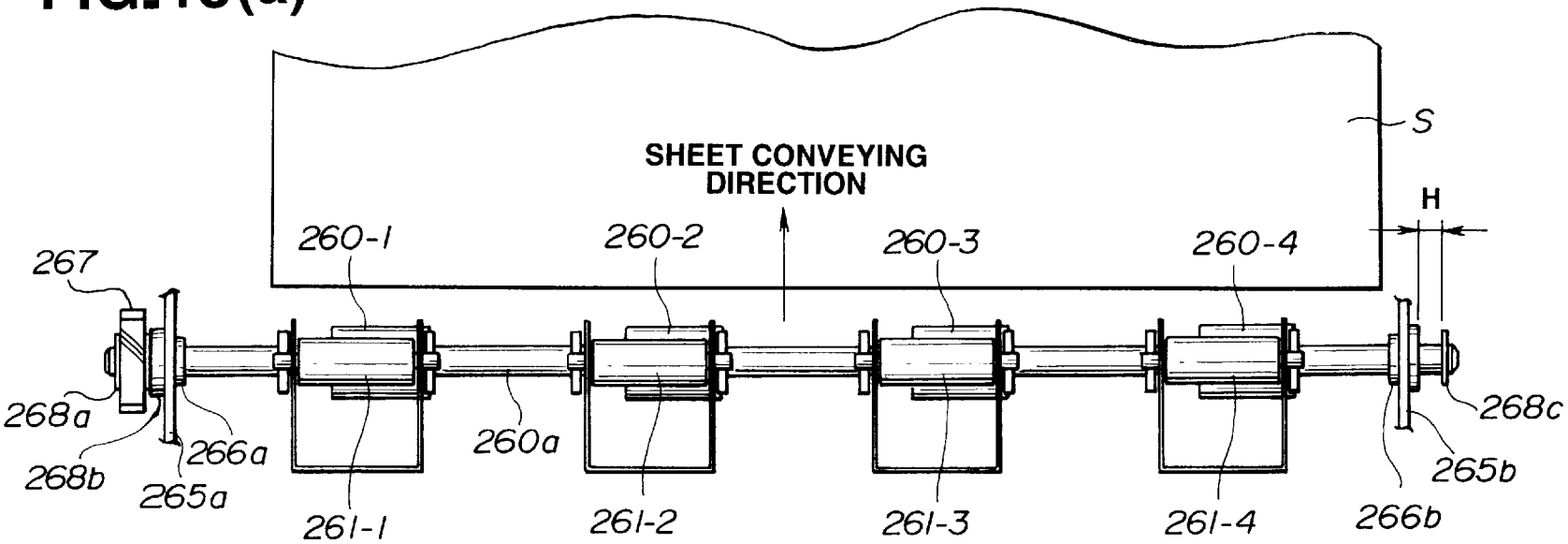
Figure 18B:
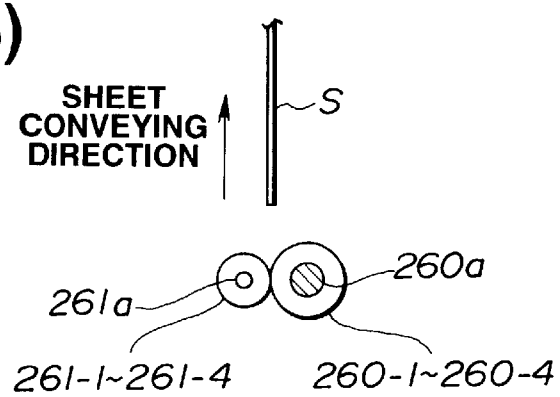

When the conveying roller 260 rotates in a reverse diirection and the sheet S is subjected to switchback conveyance as shown in FIGS. 17(*a*) and 17(*b*), the conveying roller 260 moves in the direction of the arrow (to the right) together with the grasped sheet S due to the function of the helix angle of the helical gear 267. Accordingly, as shown in FIGS. 18(*a*) and 18(*b*), the sheet S moves by a distance H before the leading edge of the sheet S is grasped by the refeeding means 272-1 and 273-1 provided at the upstream side of the regulating member 270. That is, the position of the sheet S in the lateral direction at the side contacting the conveyance reference of the regulating member 270 differs by the distance H when the sheet S is discharged from the main body 101 of the apparatus present at the upstream side and when the sheet S enters the refeeding means present at the downstream side. Hence, the sheet S is conveyed at a position closer to the conveying side by the distance H than in the above-described first mode. This situation is termed a "second mode".

The main body 101 of the apparatus usually includes detection means for detecting the size of the sheet S being used. Upon reception of a signal from this size detection means, the sheet conveying device 200 for duplex printing selects the first mode and the second mode when the sheet S has the LTR size and the A4 size, respectively. Since $$\{216 \text{ (the width of the LTR size)} - 210 \text{ (the width of the A4 size)}\} \div 2 = 3 ,$$

the distance H is set to about 3 mm.

Figure 19:
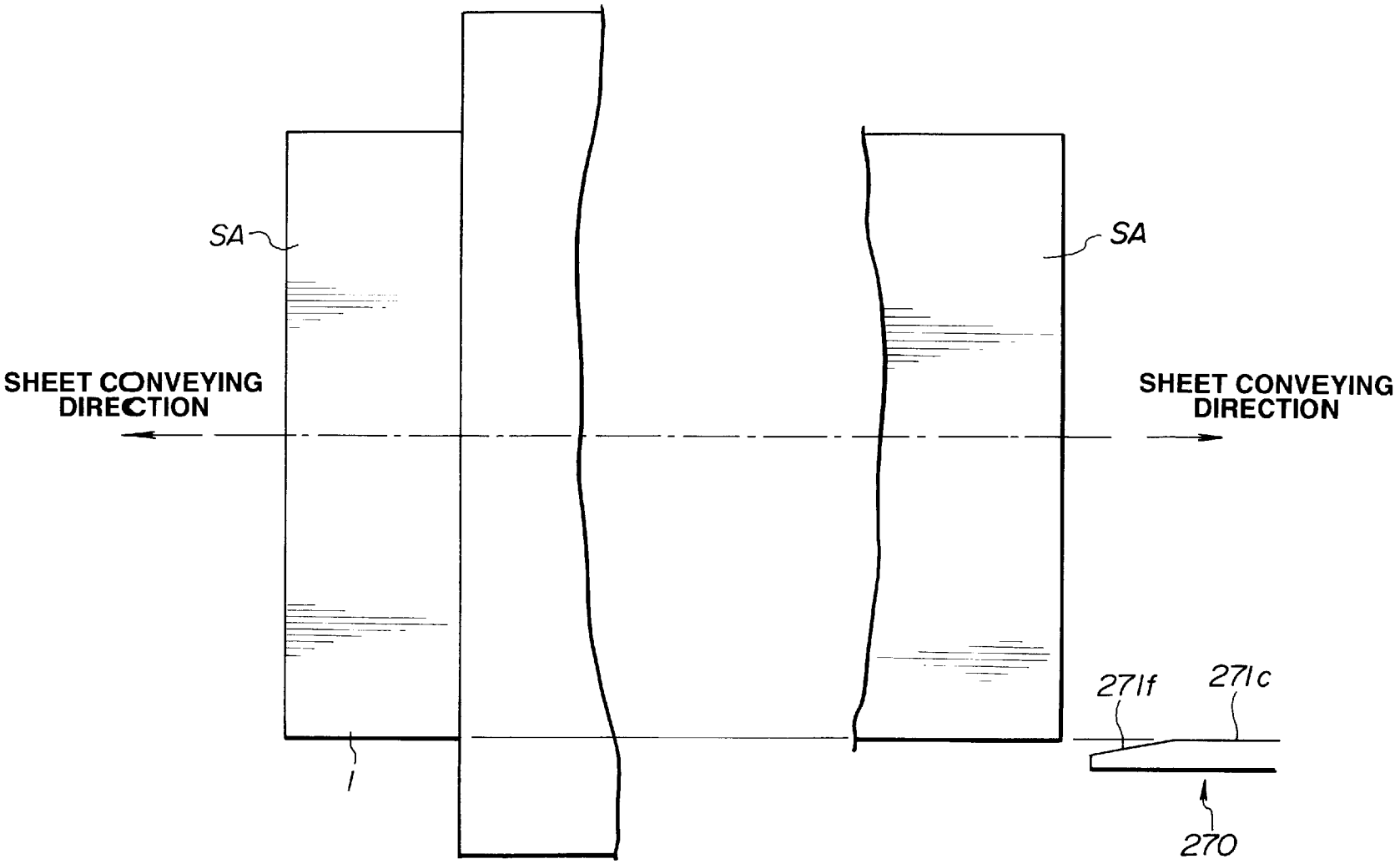
FIG. 19 is a plan view illustrating the position of an LTR-size sheet in the laterial direction before and after the sheet is subjected switchback conveyance by the switchback conveying means.

When conveying a sheet SA (the LTR size) having a larger width as shown in FIG. 19, since the first mode is set, the sheet SA is conveyed within a path P10 at substantially the same position as the position where the sheet SA is discharged from the main body 101 of the apparatus. Then, the sheet SA is conveyed in a state in which the position of the sheet SA in the lateral direction (a direction orthogonal to the sheet conveying direction) is regulated by the conveyance reference of the regulating device 270 (the guide surface 271*c*).

Figure 20:
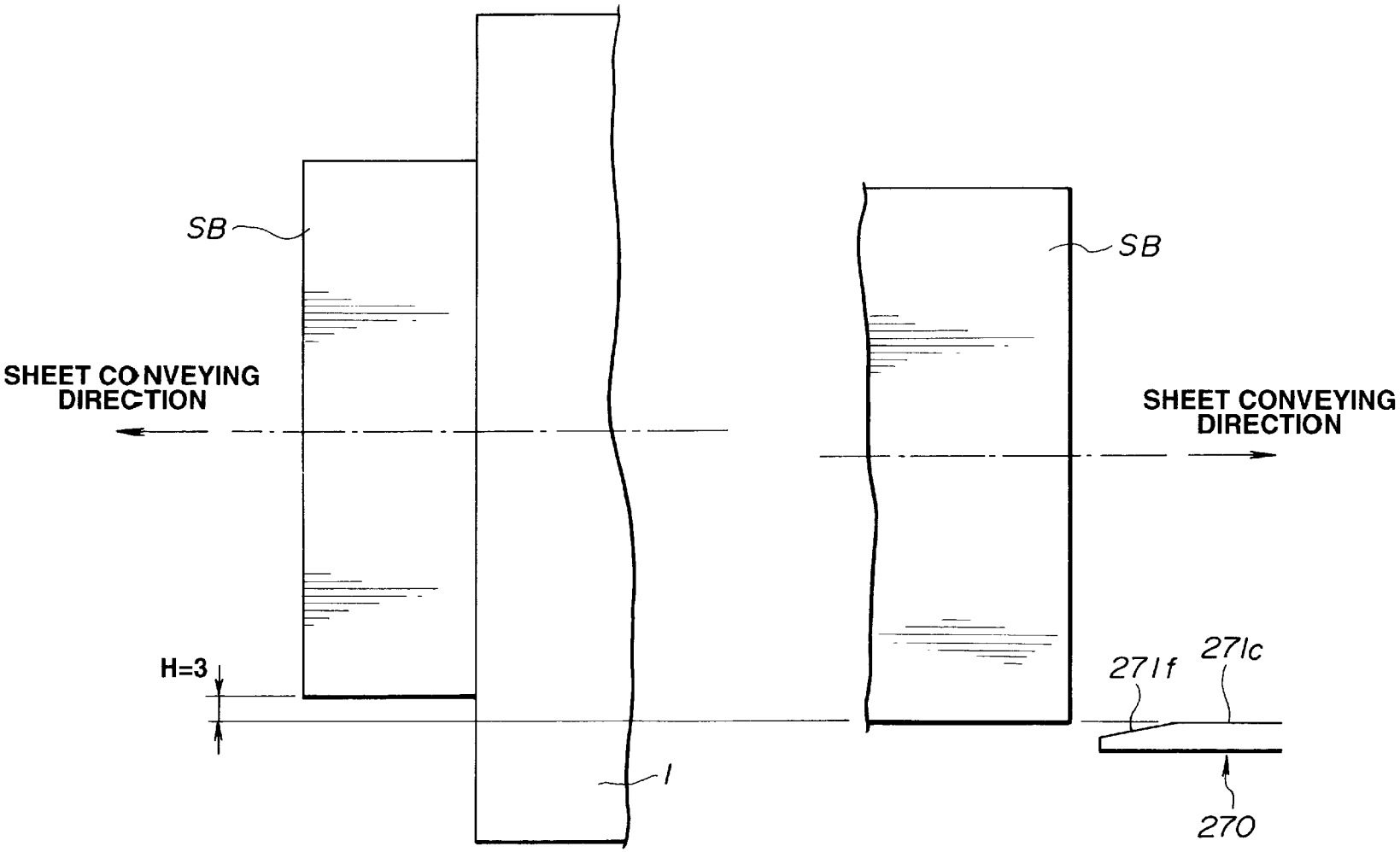
FIG. 20 is a plan view illustrating the position of an A4-size sheet in the laterial direction before and after the sheet is subjected switchback conveyance by the switchback conveying means.

When conveying a sheet SB (the A4 size) having a smaller width as shown in FIG. 20, since the second mode is set, the sheet SB is conveyed within the path P10 at a position closer to the the conveying reference of the regulating device 270 by about 3 mm from the position where the sheet SB is discharged from the main body 101 of the apparatus. In this case, it is preferable that the movement of the sheet SB in the lateral direction is completed before the leading edge of the sheet SB is grasped by the refeeding means provided at the upstream side of the regulating member 270.

As described above, even if the size of the sheet in the lateral direction differs and the position where the sheet is discharged from the main body 101 of the apparatus differs, the sheet can be conveyed to the regulating device 270 in a state in which the position of the sheet in the lateral direction at the side where the sheet contacts the conveying reference of the regulating device 270 is always the same.

When the trailing edge of the sheet S moving within the regulating device 270 leaves the nip between the switchback conveying means 260 and 261, and the leading edge of the sheet S reaches the photo-interrupter 290, the drive of motors M1 and M2 are temporarily stopped. After obtaining a timing after the lapse of a predetermined time period, only the motor M2 is driven to convey the sheet S into the main body 101 of the apparatus. On the other hand, the motor M1 waits in order to refeed the next sheet S, which is to be conveyed from the main body 101 of the apparatus, by driving the switchback conveying means 260 and 261.

Since the conveying speed of the refeeding means of the regulating device 270 is set to be substantially the same as the conveying speed of the conveying means present at the downstream side, the sheet S, whose position in the lateral direction has been regulated by the regulating device 270, is conveyed into the path P2 of the main body 101 of the apparatus from the trailing edge with the second surface faced up.

In the present embodiment, the position of the second surface of the sheet SB of the smaller width size is adjusted to the position of the sheet SA of the larger width size by the regulating device 270. Accordingly, the printed position on the second surface is shifted to provide a wider margin of about 3 mm at the left. In order to prevent such a problem, in the case of the sheet SB of the smaller width size, an image is recorded at the same position as on the first surface by correcting the position of laser irradiation on the second surface by the above-described amount.

A description has now been provided of the case of using the two kinds of sheets of different width sizes (the LTR size and the A4 size). When using more than two kinds of sheets of different width sizes, by providing detection means for detecting the position of the conveying roller 260 in the lateral direction of the sheet and controlling the rotation or the number of revolutions of the motor M1, the stop position (home position) of the conveying roller 260 can be finely controlled. That is, various kinds of sheets of different width sizes can be dealt with.

Figure 3:
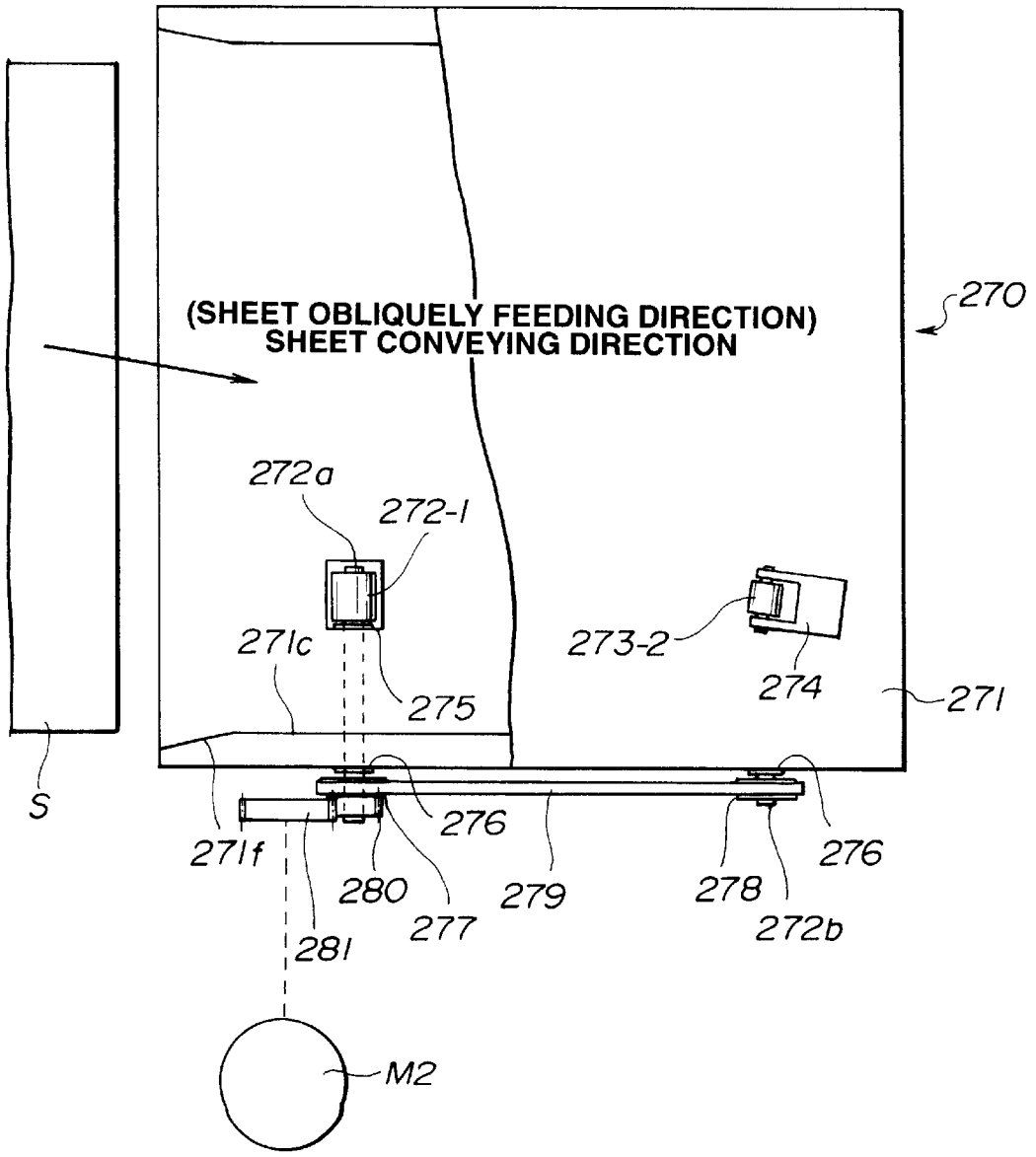
FIG. 3 is a partically cutaway plan view illustrating the configuration of a regulating device in the sheet conveying device for duplex printing shown in FIG. 1.

A description will now be provided of the configuration and the function of the regul ating device 270 with reference to FIGS. 3 and 4.

The regulating device 270 moves the sheet S having the printed image on its first surface moved within the path P9 along single-side conveyance reference. While the sheet S having the printed image on its first surface moves within the path P10, the entire one side (the front side in FIG. 3) of the sheet S in the lateral direction contacts the conveyance reference surface. The sheet S is conveyed into the main body 101 of the apparatus by refeeding means (the conveying roller 272-1 and the obliquely feeding roller 273-1, and a conveying roller 272-2 and an obliquely feeding roller 273-2) provided at the upstream side and at the downstream side of the main body 271.

A vertical guide surface (a single-side conveying reference surface) 271*c* and an inclined guide surface 271*f* are formed in the path P10.

The sheet SA passing through the path P9 enters the path P10 while being guided by the guide surface 271*f*, and moves while the refeeding means makes one side of the sheet SA in the lateral direction contact the guide surface 271*c*.

Next, a description will be provided of the configuration of the refeeding means for conveying and refeeding the sheet S having the printed image on its first surface moving within the path P10.

The refeeding means comprises the conveying rollers 272-1 and 272-2, and the obliquely feeding rollers 273-1 and 273-2. The conveying rollers 271-1 and 271-2 are fixed on roller shafts 272*a* and 272*b* arranged in a direction orthogonal to the sheet conveying direction, respectively. The roller shafts 272*a* and 272*b* are rotatably mounted on the main body 271 via bearings 275 and 276, and are connected to each other by an endless belt 279 wound around pulleys 277 and 278. When the driving force of the motor M2 is transmitted to the roller shafts 272*a* and 272*b* via gears 281 and 280, the conveying rollers 272-1 and 272-2 are rotated in a clockwise direction in FIG. 1.

The obliquely feeding rollers 273-1 and 273-2 contact the conveying rollers 272-1 and 272-2, respectively, with a predetermined pressure. The rollers 273-1 and 273-2 are supported by a leaf spring 274 mounted on the main body 271 and are urged by the leaf spring 274. Thus, the rollers 273-1 and 273-2 are rotated by being driven by the rollers 272-1 and 272-2, respectively. The nip line of the rollers 273-1 and 273-2 is inclined with respect to the nip line of the rollers 272-1 and 272-2. Accordingly, the sheet S having the printed image on its first surface grasped and conveyed by the rollers 272-1 and 272-2 and the rollers 273-1 and 273-2 is shifted toward the guide surfaces 271*c* (and 271*d*).

The path P7 is formed by guide members 224, 213 and 201*a*. The path P8 is formed by guide members 214, 201*c* and 201*d*. The path P9 is formed by guide members 201*a* and 201*b*. The guide member 224 is mounted on a cover member 220. The guide members 213 and 214 are mounted on the cover member 212. The guide members 201*a*, 201*b* and 201*c* are mounted on the main body 201. The guide member 201*d* is the base of the main body 201.

As described above, in the sheet conveying device of the first embodiment, when the sheet conveying means conveys a sheet of a specific width size (equal to or less than a maximum-width size), the sheet is conveyed by being moved toward the conveying reference position of the regulating member by a predetermined amount. Hence, even if the regulating member is fixed to a predetermined position in the lateral direction of the sheet, the sides of various kinds of sheets of different width sizes can contact the conveying reference of the regulating member in a correct state.

Accordingly, it is only necessary to provide a situation such that the sheet conveying means can move the sheet in the lateral direction, and it; is unnecessary to move the regulating member in the lateral direction of the sheet. As a result, the device is simplified and the cost of the device is reduced because moving means of the regulating member is unnecessary.

Second Fmbodiment

Figure 21:
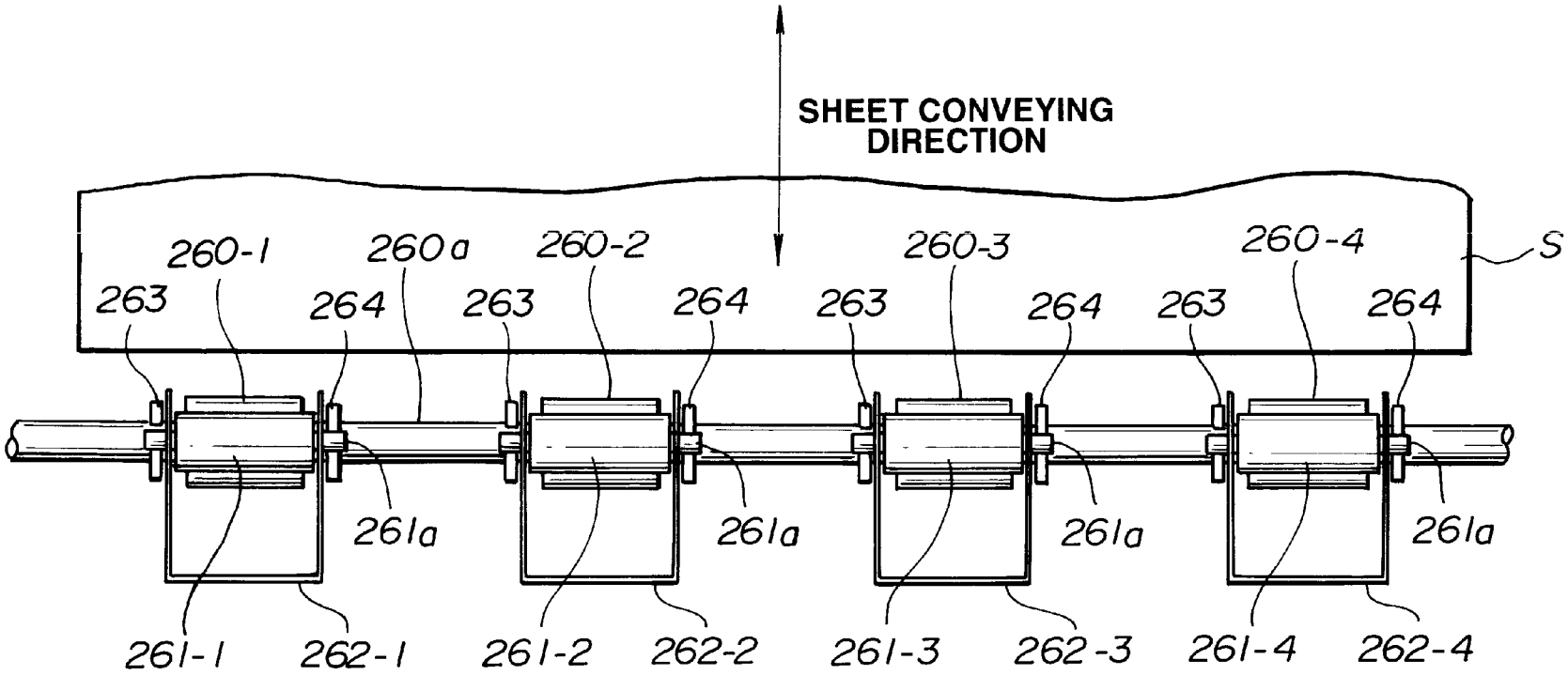
FIG. 21 is a front view illustrating the configuration of switchback conveying means in the sheet conveying device for duplex printing according to a second embodiment of the present invention.
Figure 22A:
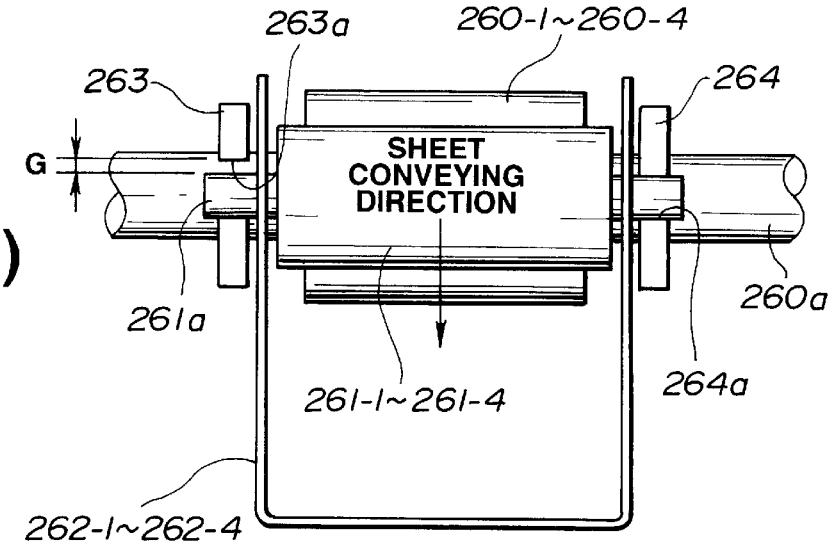
FIGS. 22(*a*) and 22(*b*) are partially enlarged front views illustrating operations and functions during ordinary conveyance and switchback coveyance, respectively, of the switchback conveying means shown in FIG. 21.
Figure 22B:
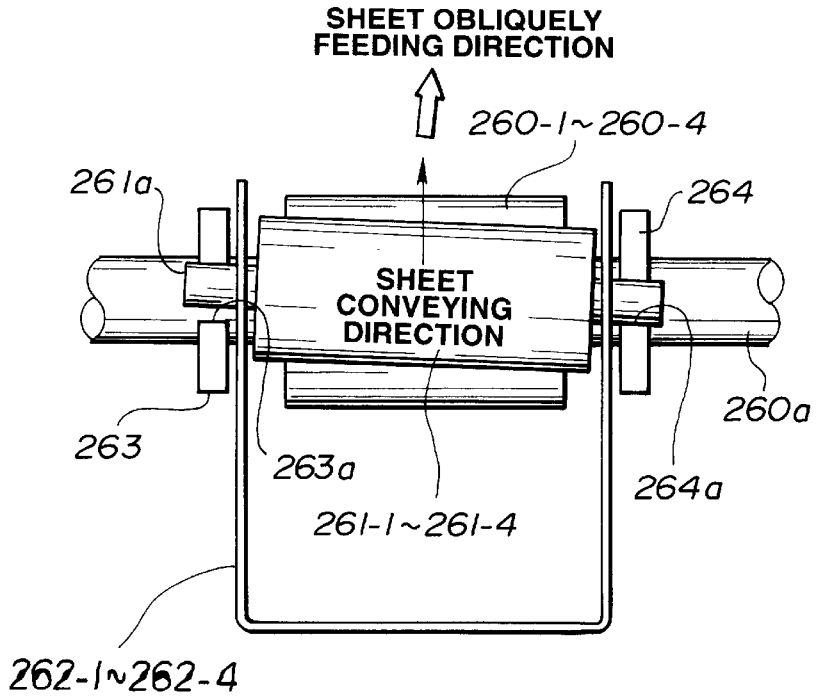

FIGS. 21, 22(*a*) and 22(*b*) illustrate the detailed configuration of the switchback conveying means (the conveying rollers 260 and 261) according to a second embodiment of the present invention. FIG. 21 is a front view obtained by seeing FIG. 4 from the left.

Figure 27:
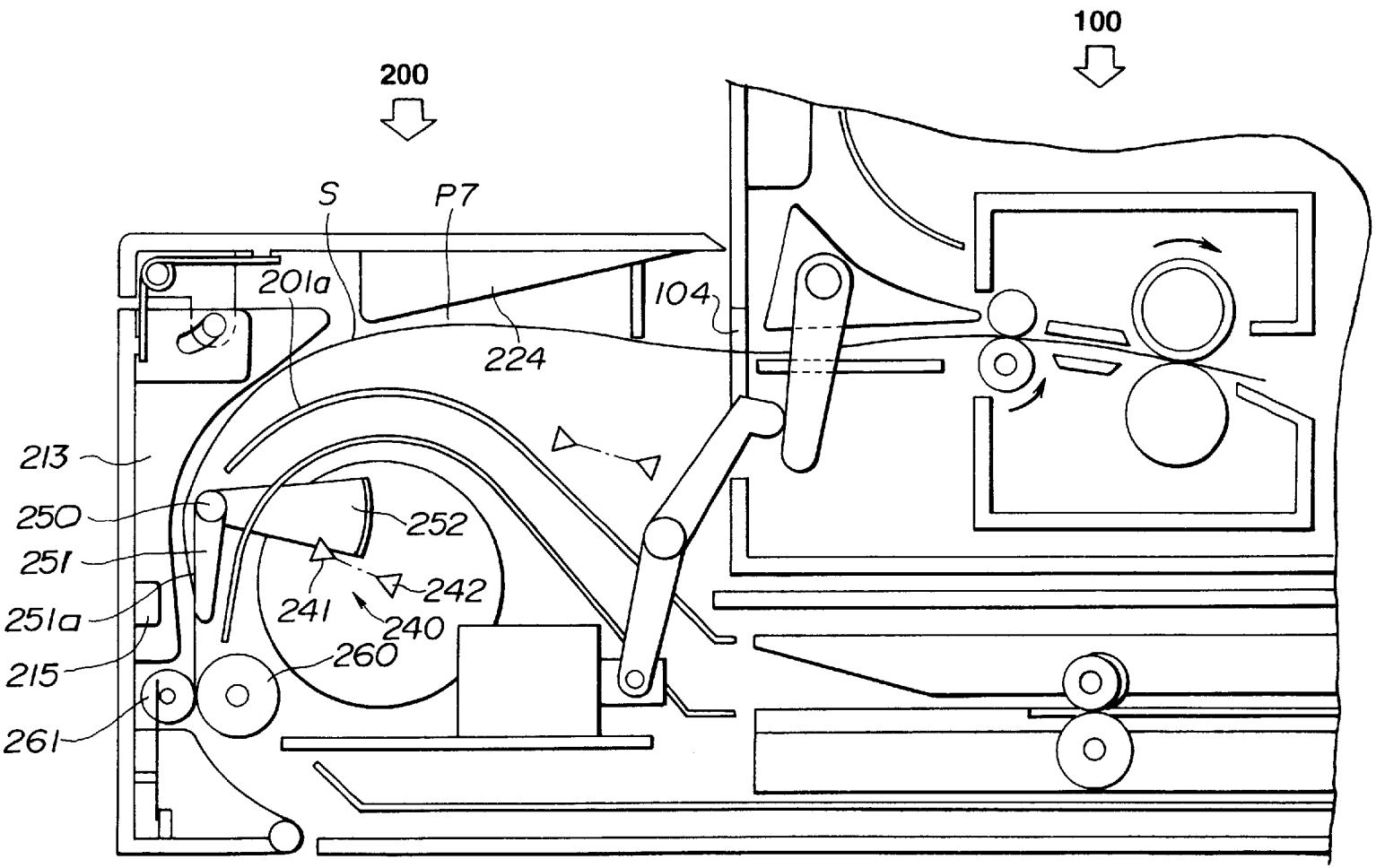
FIG. 27 is a vertical sectional side view illustrating a state in which a sheet having a printed image formed on its first surface moves within the sheet conveying device for duplex printing of the second embodiment.

In the second embodiment, also, as in the first embodiment, a sheet S having a printed image on its first surface discharged from the discharging port 104 of the main body 101 of the apparatus reaches the conveying roller 260 after passing through the path P7, and the leading edge of the sheet S enters the nip between the conveying rollers 260 and 261. At that time, the conveying roller 260 stops its rotation. Hence, the sheet S having the printed image on its first surface being discharged forms a loop at a large spatial portion at the upstream side of the path P7. Due to the formation of the loop, a skewed state of the sheet S having the printed image on its first surface is corrected. FIG. 27 illustrates the sheet S having the printed image on its first surface when the correction of the skew has ended.

The flapper 251 for reversal is provided at an upstream portion of the conveying roller 260. As shown in FIG. 4, the flapper 251 usually closes a downstream portion of the path P7. Tn this state, the flapper 251 rotates around the supporting shaft 250 in i a cIockwise direction by its own weight, and contacts the positioning member 215 provided on the cover member 212. When the side 251*a* of the flapper 251 is pressed by the leading edge of the sheet S having the printed image on its first surface moving toward the downstream side, the flappper 251 rotates around the supporting shaft 250 in a counterclockwise direction to open the path P7 and thereby pass the sheet S, as shown in FIG. 27.

As shown in FIG. 27, when the flapper 251 opens the path P7, a light-blocking member 252 linked with the rotation of the flapper 251 is separated from the optical path (between the light-emitting unit 241 and the photosensing unit 242) of a photo-interrupter 240 to turn on the photo-interrupter 240. Thus, it is possible to detect that the sheet S having the printed image on its first surface passes through the flapper 251. When the flapper 251 changes from the state of opening the path P7 to a state of closing the path P7, the light-blocking member 252 blocks the optical path of the photo-interrupter 240, whereby the photo-interrupter 240 is turned off. Thus, it is possible to detect that the trailing edge of the sheet S having the printed image on its first surface has passed through the flapper 251.

The conveying roller 260 performs ordinary conveyance of the sheet S having the printed image on its first surface by rotalin g in a cotjn terc1ockwise direction, when the predetertimined amount of loop has been formed in the sheet S having the printed image on its first surface. The sheet S having the printed image on its first surface moving toward the downstream side enters the path P8 while moving straight by this ordinary conveyance. At that time, the conveying speed of the conveying roller 260 is arranged to be higher than the conveying speed of the pair of sheet discharging rollers 153 and 154. Thus, the loop for correcting skew of the sheet S having the printed image on its first surface is rapidly resolved, so that corrugated curl is seldom produced at the trailing edge of the sheet S, and the conveying property during switchback conveyance (to be described later) is improved. FIG. 5 illustrates the sheet S having the printed image on its first surface subjected to ordinary conveyance by the conveying roller 260.

After the trailing edge of the sheet S has passed through the flapper 251 (at that time, the photo-interrupter 240 is turned off, and the flapper 251 closes the path P7), the conveying roller 260 rotates in a clockwise direction to perform switchback conveyance of the sheet S having the printed image on its first surface. FIG. 6 illustrates the sheet; S having the printed image on its first surface for which swi.tchback conveyance is started. The switchbacked sheet S having the printed image on its first surface enters the path P9 for reversal while being guided by the side 251*b* of the flapper 251 closing the path P7, and travels toward the downstream side. By passage of the sheet S having the printed image on its first surface through the path P9, the surface of the sheet S is reversed. The sheet S having the printed image on its first surface passing within the path P9 is obliquely fed to the right in the sheet conveying direction (the front side in FIG. 6) by the function of the conveying roller 261.

The conveying roller 260 comprises a plurality of rollers 260-1–260-4 arranged at a predetermined interval. Driven rollers 261-1–261-4 contact the rollers 260-1–260-4 by being urged by springs 262-1–262-4, respectively.

The driven rollers 261-1–261-4 are rotatably mounted on supporting plates 263 and 264 provided on the cover member 212. In this case, one shaft 261*a* (a right-side shaft in FIG. 21) of each of the driven rollers 261-1–261-4 is fitted in a circular hole 264*a*, and another shaft 261*a* (a left-side shaft) of each of the driven rollers 261-1–261-4 is fitted in a elliptic hole 263*a* which is long in the longitudinal direction.

When the switchback conveying means corrects the skew or the sheet S having the printed image on its first surface, and when the sheet S having the printed image on its first. surface after skew correction is conveyed, the conveying rollers 261-1–261-4 are in a state shown in FIG. 22(*a*). That is, the left shaft 261*a* contacts the lower edge of the elliptic hole 263*a* to produce a gap G. At that time, the nip line between the rollers 261-1–261-4 and the rollers 260-1–260-4 is parallel with the shaft 260*a*. Accordingly, the entire leading edge of the sheet S having the printed image on its first surface subjected to skew correction by the rollers 261-1–261-4 and the rollers 260-1–260-4 is arranged at the same position. In addition, the sheet S having the printed image on its first surface subjected to ordinary conveyance while being grasped by the rollers 261-1–261-4 and the rollers 260-1–260-4 moves straight.

FIG. 22(*b*) illustrate the state of the conveying rollers 261-1–261-4 when the switchback conveying means performs switchback conveyance of the sheet S having the printed image on its first surface. When performing switchback conveyance of the sheet S having the printed image on its first surface, the rollers 260-1–260-4 rotate in a clockwise direction in FIG. 4. Accordingly, the left shaft 261*a* of each of the rollers 261-1–261-4 rotated by being driven by the rollers 260-1–260-4 which is in a movable state moves upward, so that the nip line of the rollers 261-1–261-4 inclines down right. Thus, the sheet S having the printed image on its first. surface subjected to switchback conveyance is obliquely fed to the right in the sheet conveying direction (to the front side in FIG. 22(*b*)).

Upon completion oF the switchback conveyance (when the sheet S having the printed surface on its first surface has passed through the nip hetween the rollers 260-1–260-4 and the rollers 261-1–261-4), the switchback conveyance means returns to the initial state shown in FIG. 22(*a*) in order to perform skew correction and ordinary conveyance of the next sheet. This state is obtained by rotating the rollers 260-1–260-4 in a counterclockwise direction in FIG. 4 by a predetermined amount.

The sheet S having the printed image on its first surface passing through the path P9 after being subjected to switchback passes through the path P10 within the main body 271 of the apparatus 270 (detected by the photo-interrupter 290), then passes through the path P2 and enter the path P1, arid is conveyed to the pair of registration rollers 122 which stop. Then, the sheet S having the printed image on its first surface whose surface is reversed by the sheet conveying device 200 for duplex printing is conveyed in the same manner as in printing on the first surface, and is discharged onto the discharged-sheet tray 101*a* provided outside the apparatus by the pair of sheet discharging rollers 170 after passing through the processes of printing on the second surface and fixing the toner image formed on the second surface.

Figure 23:
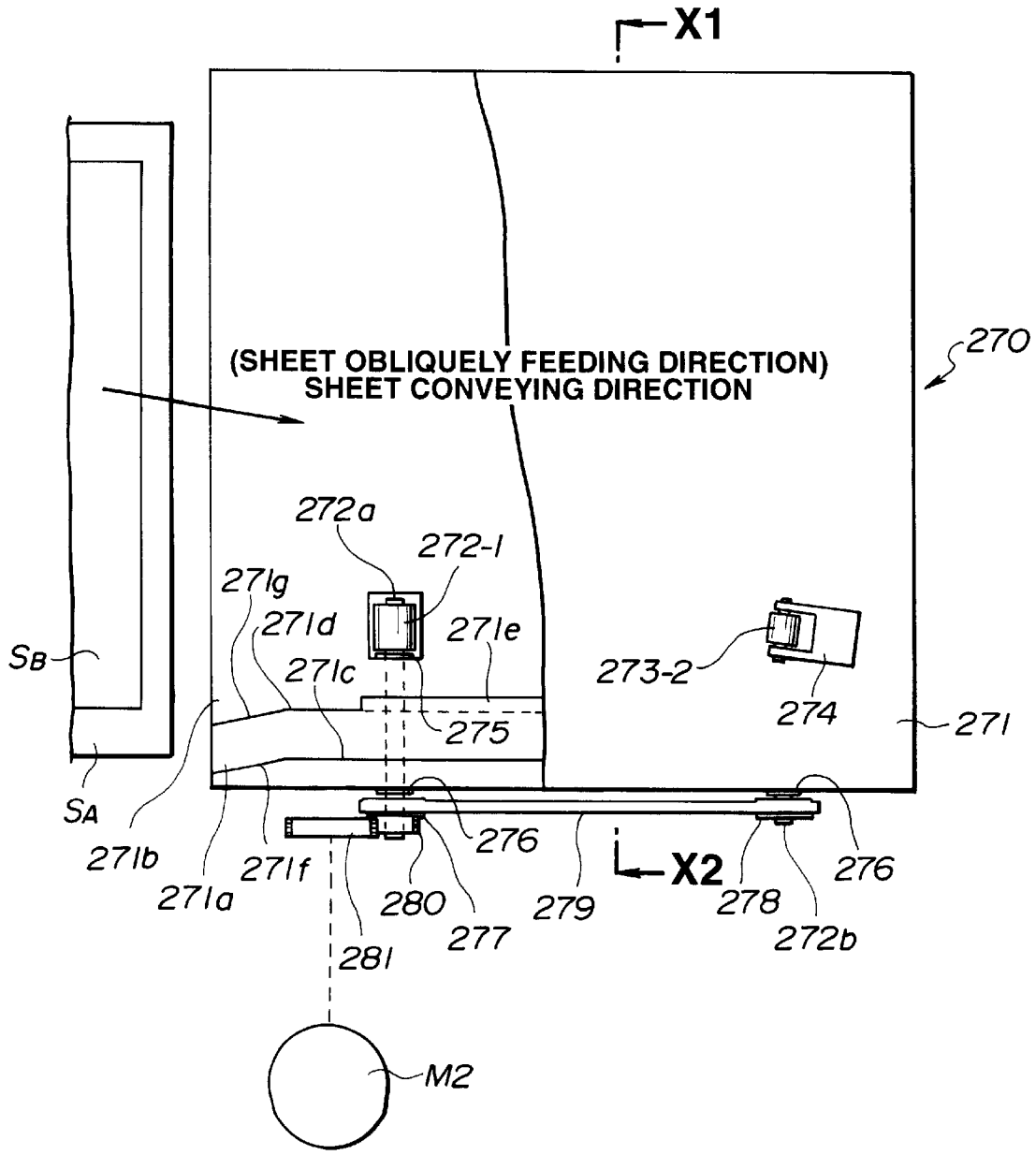
FIG. 23 is a partially cutaway plan view illustrating the configuration of a final conveying path portion in the sheet conveying device for duplex printing in the second embodiment.
Figure 24A:
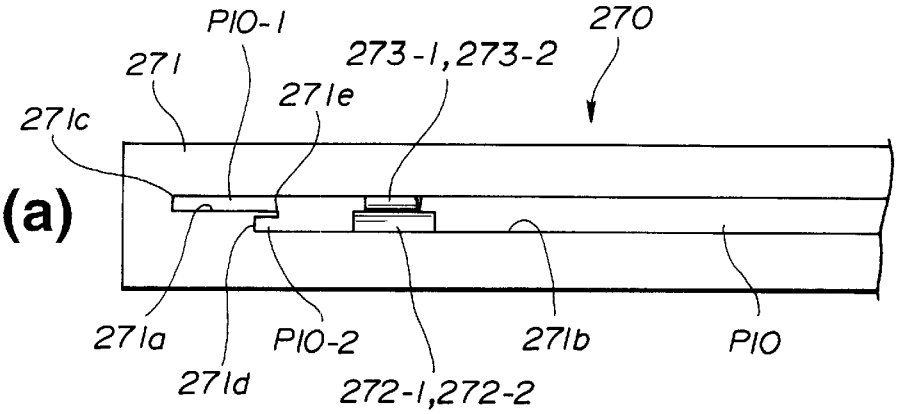
FIGS. 24(*a*) through 24(*c*) are vertical sectional front views illustrating the configuration, the operation and the function of the final conveying path portion shown in FIG. 23.
Figure 24B:
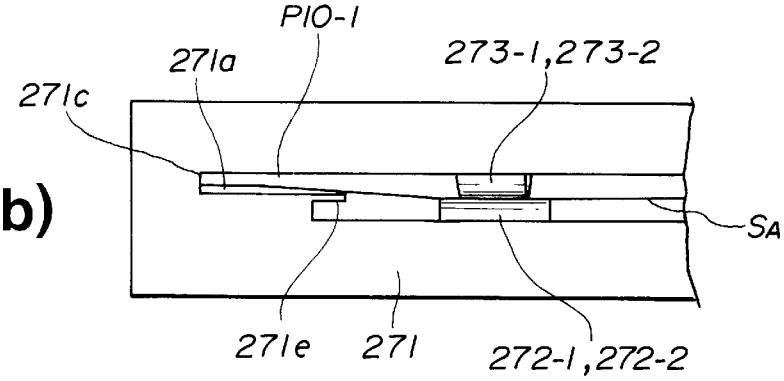
Figure 24C:
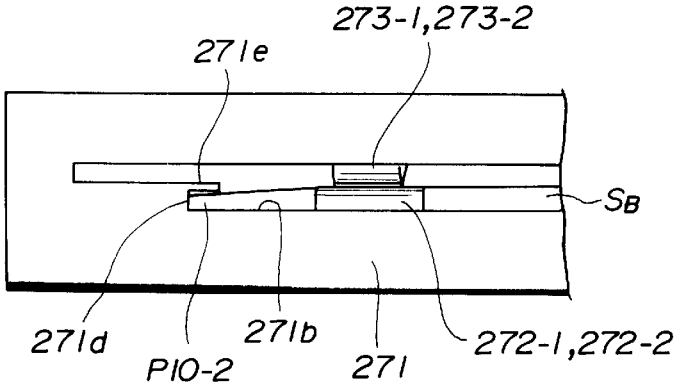

A description will now he provided of the configuration and the function of the positioning device 270 with reference to FIGS. 4, 23, and 24(*a*) through 24(*c*). FIGS. 24(*a*)–24(*c*) are cross-sectional views as seen from the direction of arrows X1 and X2 shown in FIG. 23.

The positioning device 270 adjusts the sheet S having the printed image on its first surface obliquely fed within the path P9 to move straight in a state of single-side conveyance reference. While moving within the path P10, the entire one side of the sheet S having the printed image on its first surface in the lateral direction (the front side in FIG. 23) contacts the conveyance reference surface. The path P10 comprises a path P10-1 dedicated for a sheet SA of a larger width size, and a path P10-2 dedicated for a sheet SB of a smaller width size. A sheet SA of the larger width size passing through the path P9 passes through the path P10-1, and a sheet SB of the smaller width size passing through the path P9 passes through the path P10-2. These sheets SA and SB are obliquely fed to the obliquely conveying means (a conveying roller 272-1 and an obliquely feeding roller 273-1, and a conveying roller 272-2 and an obliquely feeding roller 273-2) provided at an upstream portion and a downstream portion, respectively, of the main body 271.

The path P10-1 comprises a flat guide surface 271*a* and a vertical guide surface (single-side conveyance reference surface) 271*c*. The path P10-2 comprises a flat guide surface 271*b* and a vertical guide surface 271*d*. A partition wall 271*e* for preventing a sheet SB of the smaller width size moving within the path P1O-2 from entering the path P10-1 is formed between the paths P10-1 and P10-2. Inclined guide surfaces 271*f* and 271*g* are formed in the sheet guiding portions of the paths P10-1 and P10-2, respectively.

The sheet SA of the larger width size passing through the path P9 enters the path P10-1. while being guided by the guide surface 271*f*, and one side of the sheet SA in the lateral direction is made in contact with the guide surface 271*c* by the obliquely conveying means while the sheet SA moves on the guide surface 271*a*. FIG. 24(*b*) illustrates a state in which the sheet SA moves within the path 10-1. The sheet SB of the smaller width size passing through the path P9 enters the path P10-2 while being guided by the guide surface 271*b*, and one side of the sheet SB in the lateral direction is made in contact with the guide surface 271*d* by the obliquely conveying means while the sheet SB moves on the guide surface 271*b*. FIG. 24(*c*) illustrates a state in which the sheet SB moves within the path P10-2.

The sheet SA of the larger width size passing through the path P10-1 is, for example, an A4-size sheet or an LTR-size sheet, and the sheet SB of the smaller width size passing through the path P10-2 is, for example, a B5-size sheet or an EXEC-size sheet. In this case, since the A4 size has a smaller width than the LTR size, and the B5 size has a smaller width than the EXEC size, the distances between the respective guide surfaces 271*c* and 271*d* of the paths P10-1 and P10-2 and one sides of the A4-size and B5-size sheets in the lateral direction are large. However, these distances can be reduced by obliquely feeding the sheet S having the printed image on its first surface to be subjected to switchback.

The cover members 220 and 212 are used when performing jam removing processing. When a jam is produced within the main body 201, the cover members 220 and 212 are opened, and jam removing processing is performed. The cover member 212 is openable/closable around a supporting shaft 211. The cover member 220 is slidably supported around a supporting shaft 221 and is anchored by an anchoring shaft 223. The anchoring shaft 223 is fitted in a circular hole 217 formed in the guide member 213. Usually, the cover member 220 is urged in a counterclockwise direction by a tortion spring 222 mounted on the shaft 221 so that the anchoring shaft 223 is positioned at an upper end of the circular hole 217. The set position of the cover member 220 is detected by a photo-interrupter 230. Tn the state of FIG. 4 in which a light-blocking unit 225 does not interrupt the optical path between a light-emitting unit 231 and a photosensing unit 232, the photco-interrupter 230 is turned on, and detects that the cover member 220 is at a correct position.

Third Fmbodiment

Figure 25A:
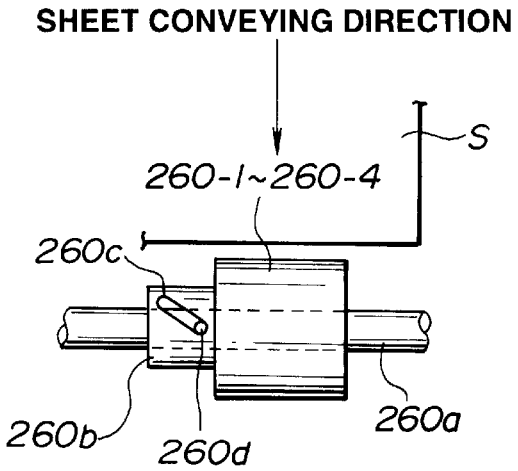
FIGS. 25(*a*) and 25(*b*) are a front view and a vertical sectional side view, respectively, illustrating the operation and the function of switchback conveying means during ordinary conveyance according to a third embodiment of the present invention.
Figure 25B:
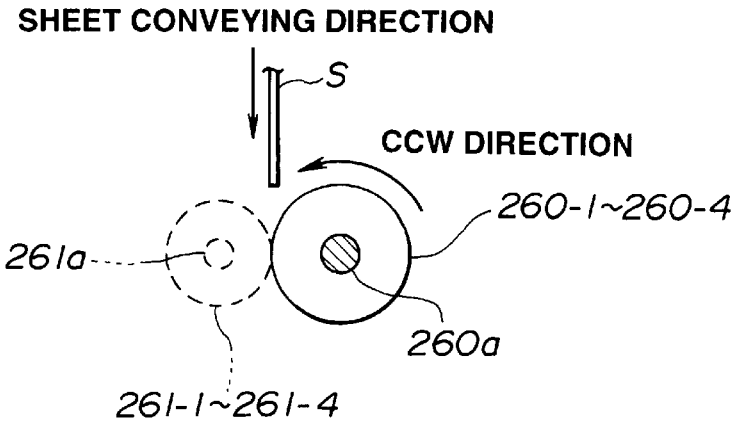

FIGS. 25(*a*) through 26(*b*) illustrate another example of the configuration of the switchback conveying means according to a third embodiment of the present invention.

In the third embodiment, oblique feeding of the sheet S having the printed image on its first surface during switchback coveyance is performed by sliding the conveying rollers 260-1–260-4 in the axial direction to change the positions relative to the conveying rollers 261-1–261-4, instead of inclining the nip line of the conveying rollers 261-1–261-4.

The respective rollers 260-1–260-4 are rotatably mounted on a shaft 260*a*. By fitting a guide shaft 260*d* provided on the shaft 260*a* into a helical groove 260*c* formed on a boss portion 260*b* of each of the rollers 260-1–260-4, the amount of rotation of the rollers 260-1–260-4 is regulated.

FIGS. 25(*a*) and 25(*b*) illustrate the set position of the rollers 260-1–260-4 during skew correction and during ordinary conveyance. At that time, the rollers 260-1–260-4 are at substantially the same positions as the rollers 261-1–261-4, and the guide shaft 260*d* is positioned at one end of the helical groove 260*c*.

Tn this state, even if the rollers 260-1–260-4 rotate in a predetermined direction, since the guide shaft 260*d* continues to contact the one end of the helical groove 260*c*, the positions of the rollers 260-1–260-4 do not change. Accordingly, the sheet S having the printed image on its first surface grasped and conveyed by the rollers 260-1–260-4 and the rollers 261-1–261-4 moves straight.

Figure 26A:
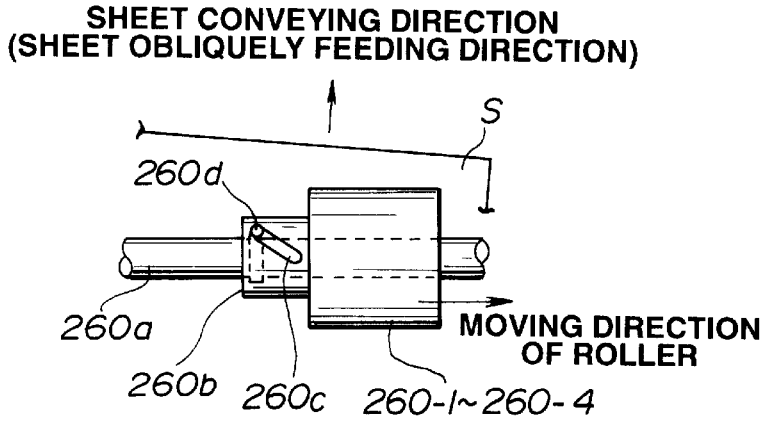
FIGS. 26(*a*) and 26(*b*) are a front view and a vertical sectional side view, respectively, illustrating the operation and the function of the switchback conveying means during switchback conveyance in the third embodiment.
Figure 26B:
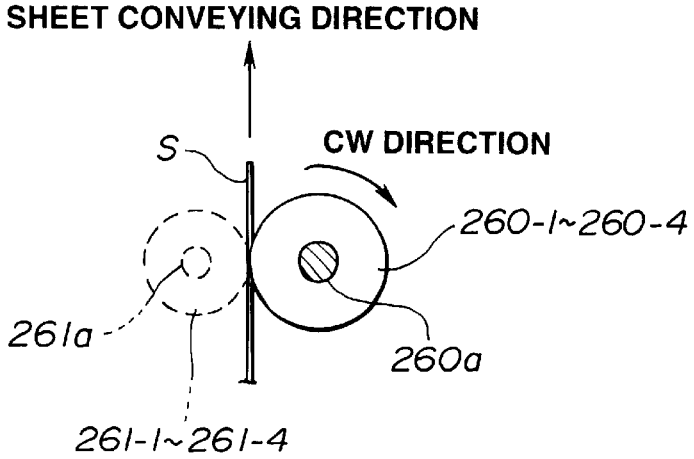

FIGS. 26(*a*) and 26(*b*) illustrate the set positions of the rollers 260-1–260-4 during switchback. When the shaft 260*a* rotates in a predetermined direction from the state of FIGS. 25(*a*) and 25(*b*), since the guide shaft 260*d* present at the position shown in FIGS. 25(*a*) and 25(*b*) moves within the helical groove 260*c*, the rollers 260-1–260-4 slide to the right in FIGS. 25(*a*) and 25(*b*) by a predetermined amount to change the set positions. When switchback conveyance is performed at this position, the sheet S having the printed image on its first surface is obliquely fed.

As described above, in the sheet conveying device of the present invention, skew correction of a sheet is performed by the switchback conveying means. Hence, a jam seldom occurs. Furthermore, it is unnecessary to provide dedicated means for skew correction.

In the sheet conveying device of the present invention, since a sheet is obliquely fed when performing switchback of the sheet by the switchback conveying means, it is possible to assuredly convey the sheet after reversal by being adjusted to single-side conveyance reference. As a result, printing on the surface of the sheet can be exactly performed.

The individual components shown in outline in the drawings are all well known in the sheet conveying device and sheet processing apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such mofidications and equivalent structures and functions.

What is claimed is:

1. A sheet conveying device comprising:

switchback conveying means for performing a switchback conveyance of a sheet after performing ordinary conveyance; and a regulating member for regulating the position of a side portion of the sheet on which is performed switchback conveyance by said switchback conveyance means, wherein said switchback conveying means moves the sheet in a direction of said regulating member during switchback conveyance, wherein said switchback conveying means performs switchback conveyance of the sheet with grasping of the sheet after performing ordinary conveyance, and wherein said switchback conveying means makes one side of the sheet contact with said regulating member during the switchback conveyance with grasping of the sheets.

2. A sheet conveying device according to claim 1, wherein said switchback conveying means comprises a pair of rollers for grasping and conveying the sheet, and wherein, by the movement of one of said pair of rollers in an axial direction, the sheet being conveyed by said pair of rollers moves toward the regulating member.

3. A sheet conveying device according to claim 1, wherein, when conveying a sheet of other width size than a maximum width size, said switchback conveying means moves the sheet toward the regulating member.

4. A sheet conveying device according to claim 1, wherein said regulating member is fixed to a position to regulate the position of a sheet of a maximum width size in a lateral direction.

5. A sheet conveying device comprising:

a sheet regulating member;

switchback conveying means for performing switchback conveyance of a sheet with grasping of the sheets after performing ordinary conveyance; and a conveyor for conveying the sheet to said switchback conveying means, wherein said switchback conveying means stops the sheet which is conveyed by said conveyor so that the sheet forms a loop to correct a skewed state of the sheet, when the leading end of the sheet arrives at switchback conveying means, and wherein said switchback conveying means makes one side of the sheet contact with said regulating member during the switchback conveyance with grasping of the sheets.

6. A sheet conveying device comprising:

switchback conveying means for performing switchback conveyance of a sheet processed and discharged by a sheet processing apparatus, and for switchback conveyance after performing said ordinary conveyance;

a conveyor for conveying the sheet on which is performed switchback conveyance by said switchback conveying means into said sheet processing apparatus;

a first single-side-reference conveying path for changing the obliquely fed state of the sheet subjected to switchback conveyance by said switchback conveying means into a straight moving state and for passing a sheet having a small width size; and a second single-side-reference conveying path for passing a sheet having a large width size;

wherein said first single-side-reference conveying path and said second single-side-reference conveying path are formed within the same path, and wherein said switchback conveying means stops so that the sheet which is discharged by a sheet processing apparatus forms a loop to correct a skewed state of the sheet, when the leading end of the sheet arrives at said switchback conveying means.

7. A sheet conveying device according to claim 5 or 6, wherein a pair of rollers capable of rotating in forward and reverse directions is used as said switchback conveying means, wherein said pair of rollers stop their rotation until the leading edge of the sheet contacts a nip and forms a loop of a predetermined amount, and performs ordinary conveyance of the sheet by rotating in predetermined directions when the loop of the predetermined amount has been formed in the sheet.

8. A sheet conveying device according to claim 7, wherein the speed of ordinary conveyance of the sheet by said switchback conveying means is higher than the moving speed of the sheet being discharged from the main body of the sheet processing apparatus.

9. A sheet conveying device comprising:

switchback conveying means for performing switchback conveyance of a sheet after performing ordinary conveyance;

a regulating member for regulating the position of a side portion of the sheet which is performing switchback conveyance by said switchback conveying means;

a first single-side-reference conveying path for changing the obliquely fed state of the sheet subjected to switchback conveyance by said switchback conveying means into a straight moving state and for passing a sheet having a small width size; and a second single-side-reference conveying path for passing a sheet having a large width size, wherein said first single-side-reference conveying path and said second single-side-reference conveying path are formed within the same path, wherein said switchback conveying means comprises at least one pair of rollers forming an inclined nip line, said pair of rollers performing switchback conveyance of the sheets with grasping of the sheets after performing ordinary conveyance, and to obliquely feed the sheet in the direction of said regulating member during switchback conveyance with grasping of the sheets.

10. A sheet conveying device comprising:

switchback conveying means for performing ordinary conveyance of a sheet which is processed and discharged by a sheet processing apparatus and for performing switchback conveyance of the sheet after said ordinary conveyance into said sheet processing apparatus, a regulating member for regulating the position of a side portion of the sheet which is performed switchback conveyance by said switchback conveying means;

wherein said switchback conveying means comprises at least one pair of rollers forming an inclined nip line, said pair of rollers performing switchback conveyance of the sheets with grasping of the sheets after performing ordinary conveyance, and to obliquely feed the sheet so that one side of the sheet is made in contact with said regulating member during the switchback conveyance with grasping of the sheets.

11. A sheet conveying device according to claim 9 or 10, wherein a pair of rollers capable of rotating in forward and reverse directions are used as said switchback conveying means, and wherein the sheet is obliquely fed by inclining of the nip line of one of said pair of rollers during switchback conveyance.

12. A sheet conveying device according to claim 11, wherein the nip lines of said two rollers become parallel with each other when said pair of rollers are driven in directions of ordinary conveyance.

13. A sheet conveying device according to claim 9 or 10, wherein a pair of rollers capable of rotating in forward and reverse directions are used as said switchback conveying means, and wherein the sheet is obliquely fed by a movement of one of said pair of rollers in an axial direction by a predetermined amount during switchback conveyance.

14. A sheet conveying device according to claim 13, wherein, when said pair of rollers are driven in directions of oridinary conveyance, the roller moved in the axial direction returns to its original position.

15. A sheet conveying device according to claim 10, further comprising a single-side-reference conveying path for changing the obliquely fed state of the sheet subjected to switchback conveyance by said switchback conveying means into a straight moving slate.

16. A sheet conveying device according to claim 15, wherein a first single-side-reference conveying path for passing a sheet having a small width size and a second single-side-reference conveying path for passing a sheet having a large width size are formed within the same path.

17. A sheet conveying device comprising:

first conveying means capable of conveying a sheet and shifting the sheet in a direction crossing a conveying direction;

a regulating member, disposed at a side downstream from said first conveying means, for regulating the position of a side portion of the sheet conveyed by said first conveying means by contacting the side portion of the sheet;

second conveying means, disposed at a side downstream from said first conveying means, for moving the sheet so as to press it against said regulating member while conveying the sheet; and control means for controlling said first conveying means so as to shift a first sheet having a first width in a direction crossing the conveying direction, and so as not to shift a second sheet having a second width different from the first width.

18. A sheet conveying device according to claim 17, wherein said first conveying means comprises rollers, and wherein the sheet is shifted by moving said rollers in a direction or a rotat ion axis.

19. A sheet conveying device according to claim 18, wherein a shaft for supporting said rollers is supported so as to be rotatable in a longitudinal direction, wherein a helical gear is provided on said shaft, and wherein a driving force is transmitted via said helical gear.

20. A sheet conveying device according to claim 19, wherein said rollers are shifted by transmitting the driving force to said helical gear.

21. A sheet conveying device according to claim 20, wherein said rollers are shifted by a component force of the driving force transmitted to said helical gear in the longitudinal direction of the shaft.

22. A sheet conveying device according to claim 21, wherein said rollers are shifted to different directions depending on the direction of rotation by a torque transmitted via said helical gear.

23. An image forming apparatus comprising:

image forming means for forming an image on a sheet;

first conveying means capable of conveying the sheet having the image formed thereon and shifting the sheet in a direction crossing a conveying direction;

a regulating member, disposed at a side downstream from said first conveying means, for regulating the position of a side portion or the sheet conveyed by said first conveying means by contacting the side portion of the sheet;

second conveying means, disposed at a side downstream from said first conveying means, for moving the sheet so as to press it against said regulating member while conveying the sheet;

control means for controlling said first conveying means so as to shift a first sheet having a first width in a direction crossing the conveying direction, and so as not to shift a second sheet having a second width different from the first width; and third conveying means for conveying the sheet conveyed by said second coveying means to said image forming means.

24. An image forming apparatus according to claim 23, wherein, when forming an image on a first sheet conveyed by said third conveying means, said image forming means forms the image at a position corresponding to a deviation of the passing position of the first sheet conveyed by said third coneying means with respect to the passing position of the first sheet during a first image forming operation.

25. A sheet conveying device comprising of:

rollers for conveying a sheet in a predetermined conveying direction by rotating in predetermined directions of rotation, and then performing switchback conveyance of the sheet by conveying it in a direction opposite to the predetermined conveying direction by rotating in direction opposite to the predetermined directions of rotation;

supporting means for supporting said rollers so as to be movable in the directions of rotation axes; and a helical gear, provided as one body with said rollers, for transmitting a driving force to said rollers, wherein said rollers are shifted in a direction crossing the predetermined conveying direction by the driving force transmitted to said helical gear when conveying the sheet so that the sheet is shifted.

26. A sheet conveying device according to claim 25, wherein said rollers shift the sheet in a first direction when conveying it in the predetermined conveying direction by moving in the directions of the rotating axes by the driving force transmitted via said helical gear, and said rollers shift the sheet in a second direction opposite to the first direction when conveying the sheet in a direction opposite to the predetermined direction.

27. A sheet conveying device according to claim 26, further comprising:

movement regulating means for regulating the movement of said rollers in the directions of the rotation axes; and control means for selectively controlling the drive of said rollers in the following two modes:

a first mode of shifting the sheet in the first direction while conveying the sheet in the predetermined conveying direction, and then shifting the sheet in the second direction while conveying the sheet in the direction opposite to the predetermined conveying direction; and a second mode of moving said rollers in the first direction lip to a point of being regulated by said movement regulating means before conveying the sheet, then conveying the sheet in the predetermined conveying direction without shifting the sheet, and then shifting in the second direction while conveying the sheet in the direction opposite to the predetermined conveying direction.

28. An image forming apparatus comprising:

image forming means for forming an image on a sheet;

first conveying means comprising rollers for conveying the sheet having the image formed thereon by said image forming means in a predetermined conveying direction by rotating in predetermined directions of rotation, and then performing swicthback conveyance of the sheet by conveying it in a direction opposite to the predetermined conveying direction by rotating in directions opposite to the predetermined directions of rotation;

supporting means for supporting said rollers so as to be movable in the directions of rotation axes;

a helical gear, provided as one body with said rollers, for transmitting a driving force to said rollers, said rollers shifting the sheet in a direction crossing the predetermined conveying direction by the driving force transmitted via said helical gear;

a regulating member, disposed at a side downstream from said rollers, for regulating the position of a side portion or the sheet conveyed by said rollers by contacting the side portion or the sheet;

second conveying means, disposed at a side downstream from said rollers, for moving the sheet so as to press it against said regulating member whil.e conveying the sheet;

control means for controlling said first conveying means so as to shift a first sheet having a first width in a direction crossing the conveying direction, and so as not to shift a second sheet having a second width different from the first width; and third conveying means for conveying the sheet conveyed by said second coveying means to said image forming means.

29. An image forming apparatus according to claim 28, wherein, when forming an image on a first sheet conveyed by said third conveying means, said image forming means forms the image at a position corresponding to a deviation of the passing position of the first sheet conveyed by said third coneying means with respect to the passing position of the first sheet during a first image forming operation.

30. A sheet conveying device comprising:

first conveying means capable of conveying a sheet and shifting the sheet in a direction crossing a conveying direction;

a first regulating member, disposed at a side downstream from said first conveying means, for regulating the position of a side portion of a first sheet having a first width conveyed by said first conveying means by contacting the side portion of the first sheet;

a second regulating member, disposed at a side downstream from said first conveying means, for regulating the position of a side portion of a second sheet having a second width larger than the first width conveyed by said first conveying means by contacting the side portion of the second sheet; and second conveying means, disposed at a side downstream from said first conveying means, for moving the sheet so as to press it against said first or second regulating member while conveying the sheet.

31. A sheet conveying device according to claim 30, wherein said first conveying means shifts the sheet toward said first or second regulating member.

32. A sheet conveying device according to claim 30, wherein said regulating member is disposed at a position higher than said first regulating member.

33. A sheet conveying device according to claim 32, further comprising:

a guide surface for guiding the side portion of the first sheet to said first regulating member by guiding the lower surface of the first sheet; and a guide surface for guiding the side portion of the second sheet to said second regulating member by guiding the lower surface of the second sheet, wherein said first regulating member, said first guide surface and said second guide surface form a step portion.

34. A sheet conveying device according to claim 33, further comprising a partition wall above said first guide surface so that the side portion of the second sheet does not contact said first regulating member.

35. A sheet processing apparatus comprising:

a sheet conveying device comprising switchback conveying means for performing a switchback conveyance of a sheet after performing ordinary conveyance; and a regulating member for regulating the position of a side portion of the sheet on which is performed switchback conveyance by said switchback conveyance means, wherein said switchback conveying means makes one side of the sheet contact with said regulating member during switchback conveyance; and sheet processing means for performing predetermined processing for the sheet conveyed by said sheet conveying device.

36. A sheet processing apparatus according to claim 35, wherein said switchback conveying means comprises a pair of rollers for grasping and conveying the sheet, and wherein, by the movement of one of said pair of rollers in an axial direction, the sheet being conveyed by said pair of rollers moves toward the regulating member.

37. A sheet processing apparatus according to claim 35, wherein, when conveying a sheet of other width size than a maximum width size, said switchback conveying means moves the sheet toward the regulating member.

38. A sheet processing apparatus according to claim 35, wherein said regulating member is fixed to a position to regulate the position of a sheet of a maximum width size in a lateral direction.

39. A sheet processing apparatus comprising:

a processing device for performing a process to a sheet;

a sheet conveying device mounted in a main body of said apparatus, comprising:

switchback conveying means for performing switchback conveyance of the sheet after the sheet has undergone a first processing operation and discharged by said processing device;

a conveyor for conveying the sheet on which switchback conveyance is performed by said switchback conveying means into said sheet processing device for performing a second process;

a first single-side-reference conveying path for changing the obliquely fed state of the sheet subjected to switchback conveyance by said switchback conveying means into a straight moving state and for passing a sheet having a small width size; and a second single-side-reference conveying path for passing a sheet having a large width size;

wherein said first single-side-reference conveying path and said second single-side-reference conveying path are formed within the same path, wherein said switchback conveying means stops so that the sheet which is discharged by said sheet processing device forms a loop to correct a skewed state of the sheet, when the leading end of the sheet arrives at said switchback conveying means, and wherein said processing device is operable in a first mode whereby the sheet subjected to a processing operation is discharged outside of said sheet conveying device, and operable in a second mode, whereby the sheet subjected to the first processing operation is discharged into said sheet conveying device for performing a second process.

40. A sheet processing apparatus according to claim 39, wherein a pair of rollers capable of rotating in forward and reverse directions is used as said switchback conveying means, wherein said pair of rollers stop their rotation until the leading edge of the sheet contacts a nip and forms a loop of a predetermined amount, and performs ordinary conveyance of the sheet by rotating in predetermined directions when the loop of the predetermined amount has been formed in the sheet.

41. A sheet processing apparatus according to claim 40, wherein the speed of ordinary conveyance of the sheet by said switchback conveying means is higher than the moving speed of the sheet being discharged from the main body of the sheet processing apparatus.

42. A sheet processing apparatus comprising:

a processing device for performing a process to a sheet;

a sheet conveying device connected to said processing device comprising:

a switchback conveying means for performing switchback conveyance of the sheet after the sheet has undergone a first processing operation and is discharged by said processing device;

a regulating member for regulating the position of a side portion of the sheet which is performing switchback conveyance by said switchback conveying means;

a first single-side-reference conveying path for changing the obliquely fed state of the sheet subjected to switchback conveyance by said switchback conveying means into a straight moving state and for sassing a sheet having a small width size; and a second single-side-reference conveying path for passing a sheet having a large width size;

wherein the first single-side-reference conveying path and the second single-side-reference conveying path are formed within the same path;

wherein said switchback conveying means comprises at least one pair of rollers forming an inclined nip line to obliquely feed the sheet toward said regulating member during switchback conveyance, and a conveyor for conveying the sheet on which is performed switchback conveyance by said switchback conveying means into said processing device for performing a second process;

wherein said processing device is operable in first made whereby the sheet subjected to a processing operation is discharged outside of said sheet conveying device, and operable in a second mode whereby the sheet subjected to the first processing operation is discharged into said sheet conveying device for performing the second process.

43. A sheet processing apparatus according to claim 42, wherein a pair of rollers capable of rotating in forward and reverse directions are used as said switchback conveying means, and wherein the sheet is obliquely fed by inclining of the nip line of one of said pair of rollers during switchback conveyance.

44. A sheet processing apparatus according to claim 42, wherein the nip lines of said two rollers become parallel with each other when said pair of rollers are driven in direction of ordinary conveyance.

45. A sheet processing apparatus according to claim 42, wherein a pair of rollers capable of rotating in forward and reverse directions are used as said switchback conveying means, and wherein the sheet is obliquely fed by a movement of one of said pair of rollers in an axial direction by a predetermined amount during switchback conveyance.

46. A sheet processing apparatus according to claim 45, wherein, when said pair of rollers are driven in directions of ordinary conveyance, the roller moved in the axial direction returns to its original position.

47. A sheet processing apparatus according to claim 42, further comprising a single-side-reference conveying path for changing the obliquely fed state of the sheet subjected to switchback conveyance by said switchback conveying means into a straight moving state.

* * * * *

UNITED STATES PATENT AND TRADEMARK OFFICE

CERTIFICATE OF CORRECTION

PATENT NO. : 6,032,949

DATED : March 7, 2000

INVENTOR(S): MASAO ANDO

It is certified that error appears in the above-identified patent and that said Letters Patent is hereby corrected as shown below:

COVER PAGE AT ITEM [57] ABSTRACT:
Line 1, "of" should be deleted; and
Line 5, "or" should read --of--.

COLUMN 2:
Line 26, "been." should read --been--.

COLUMN 5:
Line 8, "partically" should read --partially--; and
Line 50, "coveyance," should read --conveyance,--.

COLUMN 7:
Line 3, "deveoping" should read --developing--.

COLUMN 9:
Line 4, "coveying" should read --conveying--.

COLUMN 10:
Line 15, "FTG." should read --FIG.--.

COLUMN 11:
Line 48, "cannot." should read --cannot--; and
Line 52, "diirection" should read --direction--.

UNITED STATES PATENT AND TRADEMARK OFFICE

CERTIFICATE OF CORRECTION

PATENT NO. : 6,032,949

DATED : March 7, 2000

INVENTOR(S): MASAO ANDO

It is certified that error appears in the above-identified patent and that said Letters Patent is hereby corrected as shown below:

COLUMN 14:
Line 20, "Fmbodiment" should read --Embodiment--; and
Line 43, "Tn" should read --In--.

COLUMN 15:
Line 1, "rotalin g in a cotjn terclockwise" should read --rotating in a counterclockwise--.

COLUMN 16:
Line 10, "oF" should read --of--; and
Line 33, "he" should read --be--.

COLUMN 17:
Line 37, "Tn" should read --In--;
Line 40, "photco-" should read --photo- --; and
Line 65, "Tn" should read --In--.

COLUMN 20:
Line 27, "is performed" should read --performs--.

COLUMN 22:
Line 1, "coneying" should read --conveying--.

UNITED STATES PATENT AND TRADEMARK OFFICE

CERTIFICATE OF CORRECTION

PATENT NO. : 6,032,949

DATED : March 7, 2000

INVENTOR(S): MASAO ANDO

It is certified that error appears in the above-identified patent and that said Letters Patent is hereby corrected as shown below:

COLUMN 23:
Line 5, "whil.e" should read --while--; and
Line 13, "coveying" should read --conveying--.

COLUMN 25:
Line 22, "sassing" should read --passing--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*